US010225662B2

(12) United States Patent
Kim

(10) Patent No.: US 10,225,662 B2
(45) **Date of Patent: *Mar. 5, 2019**

(54) AUDIO SENSING DEVICE AND METHOD OF ACQUIRING FREQUENCY INFORMATION

(71) Applicant: SAMSUNG ELECTRONICS CO., LTD., Suwon-si (KR)

(72) Inventor: Cheheung Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/268,141

(22) Filed: Sep. 16, 2016

(65) Prior Publication Data

US 2017/0006385 A1 Jan. 5, 2017

Related U.S. Application Data

(63) Continuation of application No. 14/601,753, filed on Jan. 21, 2015, now Pat. No. 9,479,884.

(30) Foreign Application Priority Data

Aug. 13, 2014 (KR) ..... 10-2014-0105431

(51) Int. Cl.
*H04R 17/02* (2006.01)
*H04R 29/00* (2006.01)
(Continued)

(52) U.S. Cl.
CPC ..... *H04R 17/025* (2013.01); *H04R 1/245* (2013.01); *H04R 7/08* (2013.01); *H04R 29/00* (2013.01); *H04R 17/02* (2013.01); *H04R 23/006* (2013.01)

(58) Field of Classification Search
CPC ..... H04R 2201/003; H04R 29/00; H04R 29/004; H04R 1/245; H04R 1/26;
(Continued)

(56) References Cited

U.S. PATENT DOCUMENTS 1,806,871 A 5/1931 Bower
4,885,781 A 12/1989 Seidel
(Continued)

FOREIGN PATENT DOCUMENTS

CN 1595799 A 3/2005
CN 1747322 A 3/2006
(Continued)

OTHER PUBLICATIONS

Communication dated Nov. 20, 2015 issued by European Patent Office in counterpart European Patent Application No. 15155077.9.
(Continued)

*Primary Examiner* — Jason R Kurr
(74) *Attorney, Agent, or Firm* — Sughrue Mion, PLLC

(57) ABSTRACT

An audio sensing device having a resonator array and a method of acquiring frequency information using the audio sensing device are provided. The audio sensing device includes a substrate having a cavity formed therein, a membrane provided on the substrate and covering the cavity, and a plurality of resonators provided on the membrane and respectively sensing sound frequencies of different frequency bands.

36 Claims, 24 Drawing Sheets

(51) Int. Cl.
*H04R 1/24* (2006.01)
*H04R 7/08* (2006.01)
*H04R 23/00* (2006.01)

(58) Field of Classification Search
CPC ... H04R 7/00; H04R 7/06; H04R 7/08; H04R 7/10; H04R 17/02; H04R 17/025; H04R 17/10; H04R 23/006; H03H 9/02244; H03H 9/02275; H03H 2009/02283; H03H 2009/02291; H03H 9/02535; H03H 9/15; H03H 9/205; H03H 2009/155; B81B 3/0018; B81B 3/0021; B81B 2201/0257; B81C 1/00158; H01L 41/083; H01L 41/1132
USPC ..... 381/56, 355, 358, 360, 173, 175, 190, 381/338; 257/254, 416, 419
See application file for complete search history.

(56) References Cited

U.S. PATENT DOCUMENTS 5,303,210 A * 4/1994 Bernstein ..... G10K 9/12 367/181
5,870,351 A 2/1999 Ladabaum et al.
6,012,334 A 1/2000 Ando et al.
6,079,274 A 6/2000 Ando et al.
6,223,601 B1 5/2001 Harada et al.
6,314,057 B1 11/2001 Solomon et al.
6,320,239 B1 11/2001 Eccardt et al.
6,328,697 B1 12/2001 Fraser
6,430,109 B1 8/2002 Khuri-Yakub et al.
6,438,243 B1 * 8/2002 Ikeuchi ..... H04R 15/02 367/181
6,585,653 B2 7/2003 Miller
6,651,504 B1 11/2003 Datskos
7,213,460 B2 * 5/2007 Itoh ..... G01S 7/521 310/321
7,227,432 B2 6/2007 Lutz et al.
7,230,511 B2 6/2007 Onishi et al.
7,321,181 B2 1/2008 Khuri-Yakub et al.
7,594,307 B2 9/2009 Morimura et al.
7,615,834 B2 11/2009 Khuri-Yakub et al.
7,646,133 B2 1/2010 Degertekin
7,745,973 B2 6/2010 Bayram et al.
7,944,130 B2 * 5/2011 Park ..... B81B 7/04 310/317
8,687,466 B2 4/2014 Kim
8,727,994 B2 5/2014 Kim et al.
8,858,447 B2 10/2014 Chung
2008/0315331 A1 12/2008 Wodnicki et al.
2009/0140612 A1 * 6/2009 Ikeuchi ..... G01H 3/08 310/348
2010/0117485 A1 * 5/2010 Martin ..... H04R 3/00 310/319
2012/0145667 A1 6/2012 Imbert et al.
2013/0026655 A1 1/2013 Lee et al.
2013/0049528 A1 2/2013 Kim

FOREIGN PATENT DOCUMENTS

CN 203432678 U 2/2014
EP 0 903 568 A2 3/1999
EP 0 959 333 A2 11/1999
EP 0 903 568 A3 12/1999
EP 0 959 333 A3 1/2003
EP 1 909 079 A1 4/2008
GB 2 210 232 A 6/1989
JP 2000-131135 A 5/2000
JP 2000-201391 A 7/2000
JP 4859924 B2 1/2012
KR 10-0691152 B1 3/2007
KR 10-2013-0084860 A 7/2013
KR 10-2014-0028530 A 3/2014
KR 10-2014-0033992 A 3/2014
KR 10-2014-0033993 A 3/2014
KR 10-2014-0035204 A 3/2014
KR 10-2014-0068717 A 6/2014
WO 2007/111405 A1 10/2007

OTHER PUBLICATIONS

Communication dated Oct. 26, 2018, issued by the State Intellectual Property Office of P.R. China in counterpart Chinese Application No. 201510124568.9.

* cited by examiner

AUDIO SENSING DEVICE AND METHOD OF ACQUIRING FREQUENCY INFORMATION

CROSS-REFERENCE TO RELATED APPLICATION(S)

This application is a continuation of U.S. patent application Ser. No. 14/601,753, filed on Jan. 21, 2015, which claims priority from Korean Patent Application No. 10-2014-0105431, filed on Aug. 13, 2014 in the Korean Intellectual Property Office, the disclosures of which are incorporated herein in their entireties by reference.

BACKGROUND

1. Field

Apparatuses and methods consistent with exemplary embodiments relate to audio sensing, and more particularly, to an audio sensing device that has a resonator array and a method of acquiring frequency information using the audio sensing device.

2. Description of Related Art

Frequency domain information of sound may be analyzed in an environment such as mobile phones, computers, home appliances, automobiles, and the like. In general, frequency domain information of an audio signal is acquired as the audio signal is input to a microphone. The audio signal may have wide band characteristics and may pass through an analog digital converter (ADC) and undergo a Fourier transformation. However, the frequency information acquisition method requires a large amount of calculation because a Fourier transformation is complicated and burdensome.

In cellular phones, computers, home appliances, cars, smart homes, and the like, an audio receiver should always be in a ready state to execute a voice command. Also, to recognize high level information, sound frequency domain information should be continuously analyzed. Furthermore, in order to separate an audio signal of a speaker from surrounding noise, frequency characteristics with respect to the noise may be used. When the surrounding noise is continuously analyzed and stored in a database, noise may be effectively removed. Analysis of the surrounding noise may be used to help to identify a place and a type of an action. To this end, frequency domain information with respect to the surrounding noise may be always monitored.

To this end, a solution having low power and a fast response speed and being capable of monitoring frequency domain information in an always-ready state may be required. In general, frequency domain information of an audio signal is acquired as an audio signal is input to a microphone having wide band characteristics passes through an analog digital converter (ADC) and undergoes a Fourier transformation. However, the frequency information acquisition method requires a large amount of calculation due to the Fourier transformation, which is burdensome. The frequency domain information being always monitored in the above method is not preferable in view of power management.

SUMMARY

Exemplary embodiments overcome the above disadvantages and other disadvantages not described above. Also, an exemplary embodiment is not required to overcome the disadvantages described above, and an exemplary embodiment may not overcome any of the problems described above.

One or more exemplary embodiments provide an audio sensing device that has a resonator array and a method of acquiring frequency information using the audio sensing device.

Additional aspects will be set forth in part in the description which follows and, in part, will be apparent from the description, or may be learned by practice of the presented exemplary embodiments.

According to an aspect of an exemplary embodiment, there is provided an audio sensing device including a substrate having a cavity formed therein, a membrane provided on the substrate and covering the cavity, and a plurality of resonators provided on the membrane and respectively configured to sense sound frequencies of different frequency bands.

The plurality of resonators may be disposed inside the cavity and an interior of the cavity is maintained in a vacuum state. A degree of vacuum in the interior of the cavity is less than or equal to 100 Torr. The plurality of resonators are arranged on the membrane in one dimension or two dimensions. A number of the plurality of resonators may be in a range of tens to thousands.

Each of the plurality of resonators may include a first electrode provided on the membrane, and a second electrode fixedly provided on the membrane and spaced apart from the first electrode. The first electrode may be a common electrode. A first insulating layer may be provided between the membrane and the first electrode. A second insulating layer may be interposed between the first electrode and the second electrode and may be provided on one of the first electrode and the second electrode. One end or opposite ends of the second electrode may be fixed on the membrane. The first and second electrodes may include a conductive material.

Each of the plurality of resonators may include a first electrode fixedly provided on the membrane, a second electrode spaced apart from the first electrode, and a piezoelectric layer provided between the first and second electrodes. One end or opposite ends of the first electrode may be fixed on the membrane. An insulating layer may be provided between the membrane and the first electrode. The piezoelectric layer may include at least one of ZnO, SnO, PZT, $ZnSnO_3$, polyvinylidene fluoride (PVDF), poly(vinylidene fluoride-trifluoroethylene) (P(VDF-TrFE)), AlN, and PMN-PT.

The first and second electrodes may include a conductive material. At least two of the plurality of resonators may sense frequencies of a same band. The substrate may include silicon. The membrane may include at least one of silicon, a silicon oxide, a silicon nitride, metal, and a polymer.

Sound frequency bands to be sensed may be adjusted by changing dimensions of the plurality of resonators. The membrane may be configured to receive an input audio signal of an audible frequency range or an ultrasonic frequency range.

According to an aspect of another exemplary embodiment, there is provided an audio sensing device including a membrane configured to vibrate in response to sound, and a plurality of resonators provided on the membrane and respectively configured to sense different frequency bands of the sound.

The plurality of resonators may be disposed in a vacuum state.

Each of the plurality of resonators may include a first electrode provided on the membrane, and a second electrode fixedly provided on the membrane and spaced apart from the first electrode. The first electrode may be a common electrode. A first insulating layer may be provided between the membrane and the first electrode. A second insulating layer to insulate between the first electrode and the second electrode may be provided on at least one of the first electrode and the second electrode. One end or opposite ends of the second electrode may be fixed on the membrane. The first and second electrodes may include a conductive material.

Each of the plurality of resonators may include a first electrode fixedly provided on the membrane, a second electrode spaced apart from the first electrode, and a piezoelectric layer provided between the first and second electrodes. One end or opposite ends of the first electrode may be fixed on the membrane. An insulating layer may be provided between the membrane and the first electrode. The piezoelectric layer may include at least one of ZnO, SnO, PZT, $ZnSnO_3$, polyvinylidene fluoride (PVDF), poly(vinylidene fluoride-trifluoroethylene) (P(VDF-TrFE)), AlN, and PMN-PT.

At least two of the plurality of resonators may sense frequencies of a same band. The substrate may include silicon. The membrane may include at least one of silicon, a silicon oxide, a silicon nitride, metal, and a polymer. Sound frequency bands to be sensed may be capable of being adjusted by changing dimensions of the plurality of resonators.

BRIEF DESCRIPTION OF THE DRAWINGS

The above and/or other aspects will become apparent and more readily appreciated from the following description of the exemplary embodiments, taken in conjunction with the accompanying drawings, in which.

DETAILED DESCRIPTION

Figure 1:
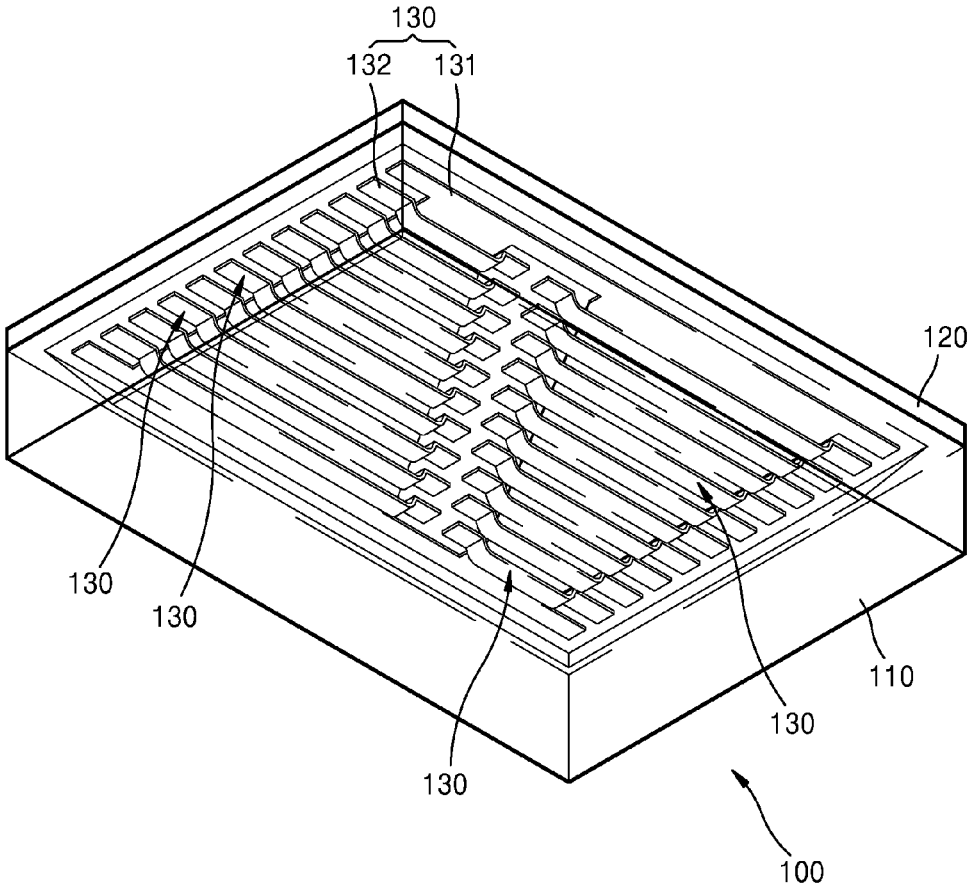
FIG. 1 is a perspective view of an audio sensing device according to an exemplary embodiment.

Reference will now be made to the exemplary embodiments, examples of which are illustrated in the accompanying drawings, wherein like reference numerals refer to like elements throughout and the thickness or size of each layer illustrated in the drawings may be exaggerated or reduced for convenience of explanation and clarity. In this regard, one or more exemplary embodiments may have different forms and should not be construed as being limited to the descriptions set forth herein.

Accordingly, the exemplary embodiments are described below, by referring to the figures, to explain aspects of the present description. In the following description, when a layer is described to exist on another layer, the layer may exist directly on the other layer or another layer may be interposed therebetween. Also, because materials forming each layer in the following embodiments are exemplary, other materials may be used. As used herein, the term "and/or" includes any and all combinations of one or more of the associated listed items. Expressions such as "at least one of," when preceding a list of elements, modify the entire list of elements and do not modify the individual elements of the list.

According to the exemplary embodiments provided herein, a plurality of resonators are provided in an audio sensing device and selectively sense sound frequencies of predetermined bands. Accordingly, frequency domain information with respect to an audio signal that is externally input may be easily acquired. According to one or more exemplary embodiments, because a Fourier transformation process that consumes a large amount of electric power is removed and such a Fourier transformation function is embodied through a resonator array of that has a mechanical structure, consumption of power may be greatly reduced.

Also, because a signal is output in direct response to an external audio signal, frequency domain information may be quickly acquired. Accordingly, the frequency domain information of an audio signal may be monitored in real time using low power and at a fast speed in an always-ready state. Furthermore, noise generated nearby may be effectively removed.

Figure 2:
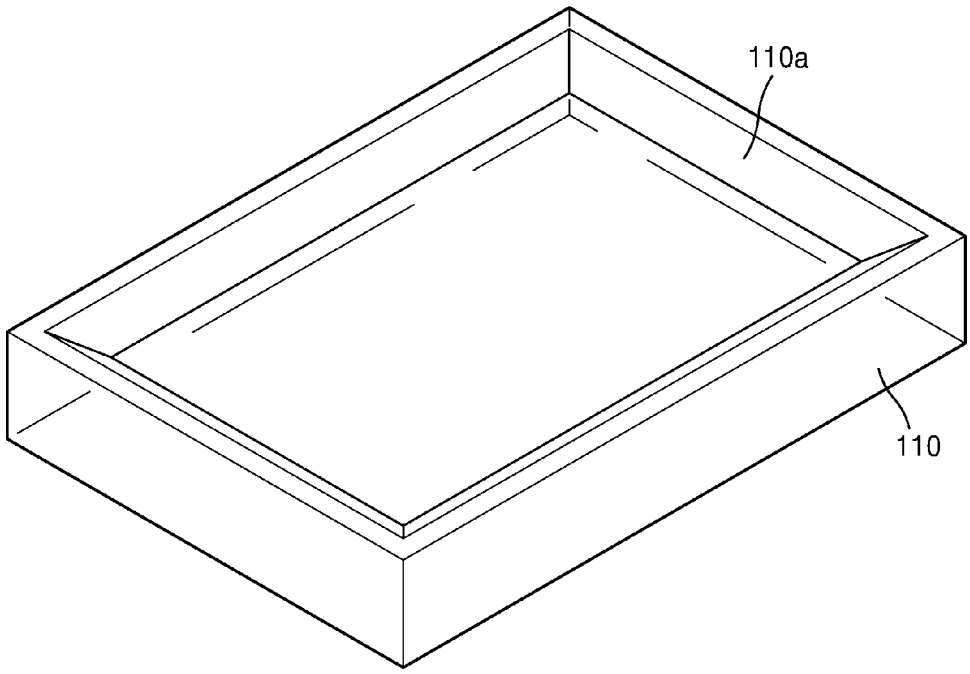
FIG. 2 is a perspective diagram of a substrate of the audio sensing device of FIG. 1 according to an exemplary embodiment.
Figure 3:
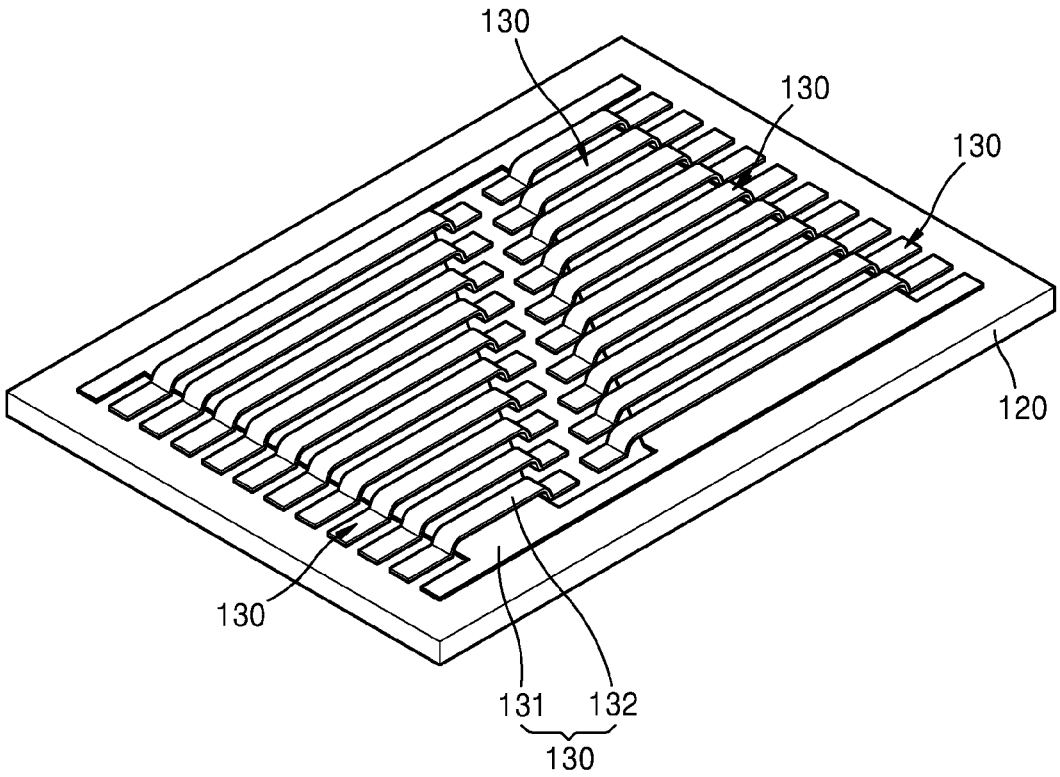
FIG. 3 is a perspective view of a membrane on which resonators of the audio sensing device of FIG. 1 are provided according to an exemplary embodiment.
Figure 4:
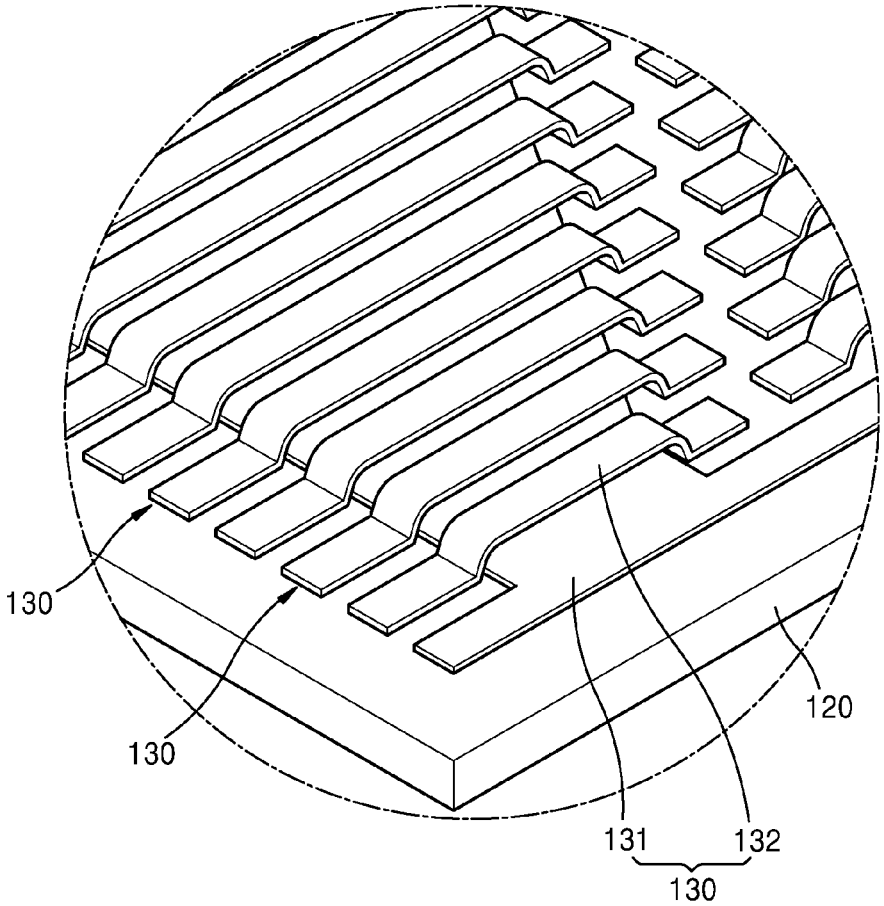
FIG. 4 is an enlarged view of the example of FIG. 3 according to an exemplary embodiment.

FIG. 1 is a perspective view of an audio sensing device 100 of FIG. 1 according to an exemplary embodiment. FIG. 2 is a perspective view of a substrate of the audio sensing device 100 of FIG. 1 according to an exemplary embodiment. FIG. 3 is a perspective view of a membrane on which resonators of the audio sensing device of FIG. 1 are provided according to an exemplary embodiment. FIG. 4 is an enlarged view of a portion of FIG. 3 according to an exemplary embodiment.

Referring to FIGS. 1 to 4, the audio sensing device 100 includes a substrate 110, a membrane 120, and a plurality of resonators 130. A silicon substrate, for example, may be used as the substrate 110. However, the exemplary embodiments are not limited thereto and it should be appreciated that the substrate 110 may include various other materials. A cavity 110*a* (shown in FIG. 2) is formed in a surface of the substrate 110 at a predetermined depth.

The membrane 120 (shown in FIG. 1) is provided at one surface of the substrate 110 to cover the cavity 110*a*. For example, the interior of the cavity 110*a* may be maintained in a vacuum state. The vacuum state of the interior of the cavity 110*a* may be maintained at a pressure that is lower than the atmospheric pressure, for example, at a degree of a vacuum that is equal to or less than about 100 Torr, particularly at a degree of vacuum equal to or less than about 1000 mTorr, but the exemplary embodiments are not limited thereto. The membrane 120 may include, for example, one or more of silicon, a silicon oxide, a silicon nitride, metal, a polymer, and the like. However, these materials are exemplary and it should be appreciated that the membrane 120 may include various other materials.

The membrane 120 may receive an audio signal of a wide band. For example, the membrane 120 may receive an audio signal in an audible frequency range from between about 20 Hz~about 20 kHz. As another example, the membrane 120 may receive an audio signal in an ultrasonic frequency range of about 20 kHz or higher, or an audio signal in an infrasonic frequency range of about 20 Hz or lower.

The resonators 130 are arranged on a surface of the membrane 120 and may have a predetermined shape. In the example of FIG. 1, the resonators 130 are provided on an inner surface of the membrane 120 contacting the cavity 110*a* formed in the substrate 110 and disposed inside the cavity 110*a* that is maintained in a vacuum state. According to various embodiments, if the ambient environment of the resonators 130 is maintained in a vacuum state, a Quality factor (Q factor) of the resonators 130 may be improved.

The resonators 130 may sense sound frequencies that have different bandwidths. For example, the resonators 130 may have different dimensions on the membrane 120. That is, the resonators 130 may be provided on the membrane 120 such that they have different lengths, widths, and/or thicknesses. Although the number of the resonators 130 provided on the membrane 120 may be, for example, tens to several thousands, the exemplary embodiments are not limited thereto and the number of the resonators 130 may be diversely modified according to design conditions. An insulating layer may be further formed on the inner surface of the membrane 120 on which the resonators 130 are provided. The insulating layer may be used to insulate the membrane 120 and the resonators 130 when the membrane 120 includes a conductive material.

Each of the resonators 130 may be an electro-static resonator. Referring to the examples of FIGS. 3 and 4, a first electrode 131 is provided on the inner surface of the membrane 120, whereas a plurality of second electrodes 132 having different lengths are provided and are spaced apart from the first electrode 131. Opposite ends of each of the second electrodes 132 are fixed on the inner surface of the membrane 120. Each of the resonators 130 includes the first and second electrodes 131 and 132 that are spaced apart from each other. The first and second electrodes 131 and 132 may include a conductive material, for example, a metal that has superior electrical conductivity. However, the exemplary embodiments are not limited thereto. For example, the first and second electrodes 131 and 132 may include a transparent conductive material such as indium tin oxide (ITO).

The first electrode 131 may be provided on the inner surface of the membrane 120 facing the cavity 110*a*. The first electrode 131 may be a common electrode as illustrated in FIGS. 3 and 4. As another example, the first electrode 131 may be a separate electrode provided to correspond to each of the second electrodes 132. The second electrodes 132 are spaced apart from the first electrode 131 and have the opposite ends fixed on the inner surface of the membrane 120. The second electrodes 132 may each have a width of about several micrometers or less, a thickness of several micrometers or less, and a length of several millimeters or less. As an example, the resonators 130 having the above fine size may be manufactured by a micro electro-mechanical system (MEMS).

In the electro-static predetermined resonator 130 having the above structure, the second electrode 132 vibrates according to a movement of the membrane 120. In this example, an interval between the first and second electrodes 131 and 132 changes and a capacitance between the first and second electrodes 131 and 132 may vary accordingly. An electric signal may be sensed from the first and second electrodes 131 and 132 according to the change of the capacitance. As a result, the predetermined resonator 130 may sense a sound frequency in a particular range. For example, the frequency range that is capable of being sensed by the predetermined resonator 130 may be determined by the length of the second electrode 132 corresponding to the length of the predetermined resonator 130.

The audio sensing device 100 of FIG. 1 may be manufactured by bonding the substrate 110 including the cavity 110*a* formed therein and the membrane 120 including the resonators 130 formed thereon, in a vacuum state. The vacuum state may be at a degree of a vacuum that is equal to or less than about 100 Torr, for example, about 1000 mTorr as described above. The surface of the membrane 120 in which the resonators 130 are arranged may be bonded to the surface of the substrate 110 in which the cavity 110*a* is formed. Accordingly, the resonators 130 may be disposed inside the cavity 110*a*. For example, when the substrate 110 and the membrane 120 are both formed of silicon, the substrate 110 and the membrane 120 may be bonded to each other by silicon direct bonding (SDB). As another example, when the substrate 110 and the membrane 120 are formed of different materials, the bonding of the substrate 110 and the membrane 120 may be performed by, for example, adhesive bonding. However, the exemplary embodiments are not limited thereto and the substrate 110 and the membrane 120 may be bonded to each other by various other bonding methods.

Figure 5:
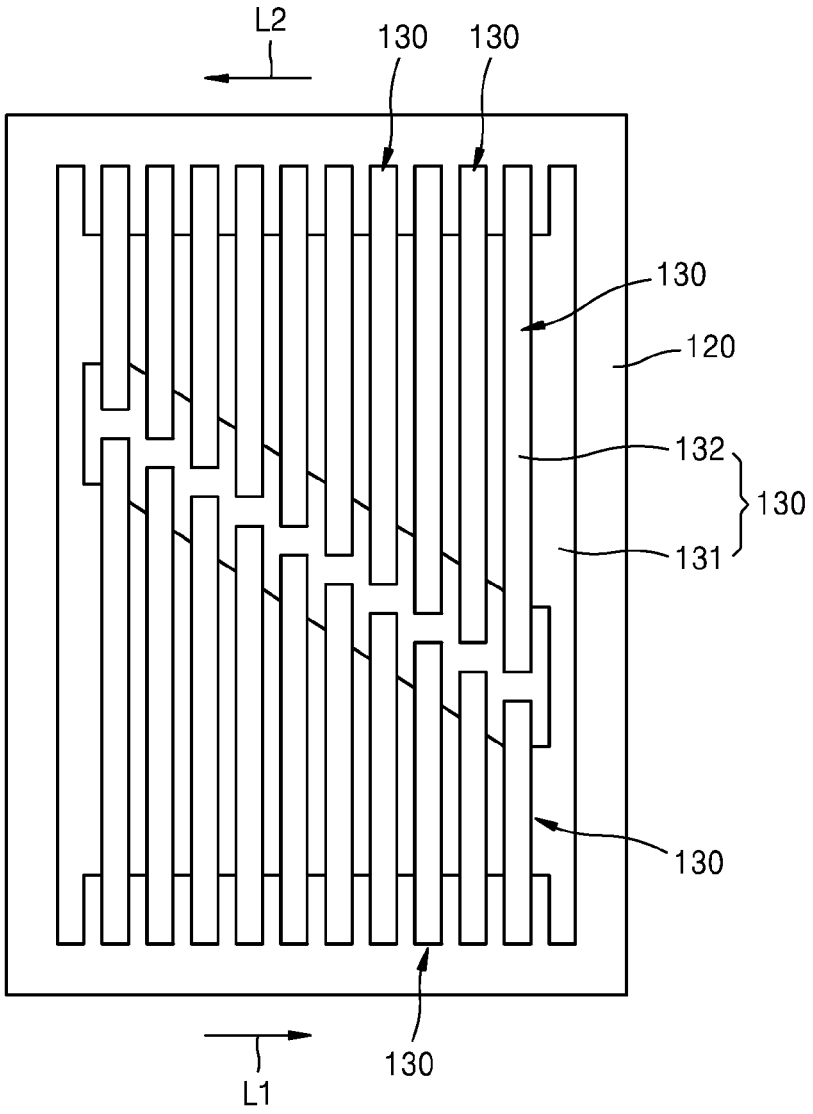
FIG. 5 is a plan view illustrating an array of the resonators provided on the membrane in the audio sensing device of FIG. 1 according to an exemplary embodiment.

FIG. 5 is a plan view illustrating an array of the resonators 130 provided on the membrane 120 in the audio sensing device 100 of FIG. 1, according to an exemplary embodiment.

Referring to FIG. 5, the resonators 130 are arranged in two dimensions on the membrane 120. In this example, the resonators 130 are arranged on the membrane 120 in first and second directions L1 and L2 that are parallel to each other and opposite to each other. Also, the resonators 130 have different lengths from each other and are arranged such that lengths of the resonators 130 decrease in the first and second directions L1 and L2. However, this is merely one example and the resonators 130 may be arranged variously in one dimension, two dimensions, or three dimensions, on the membrane 120.

Figure 6:
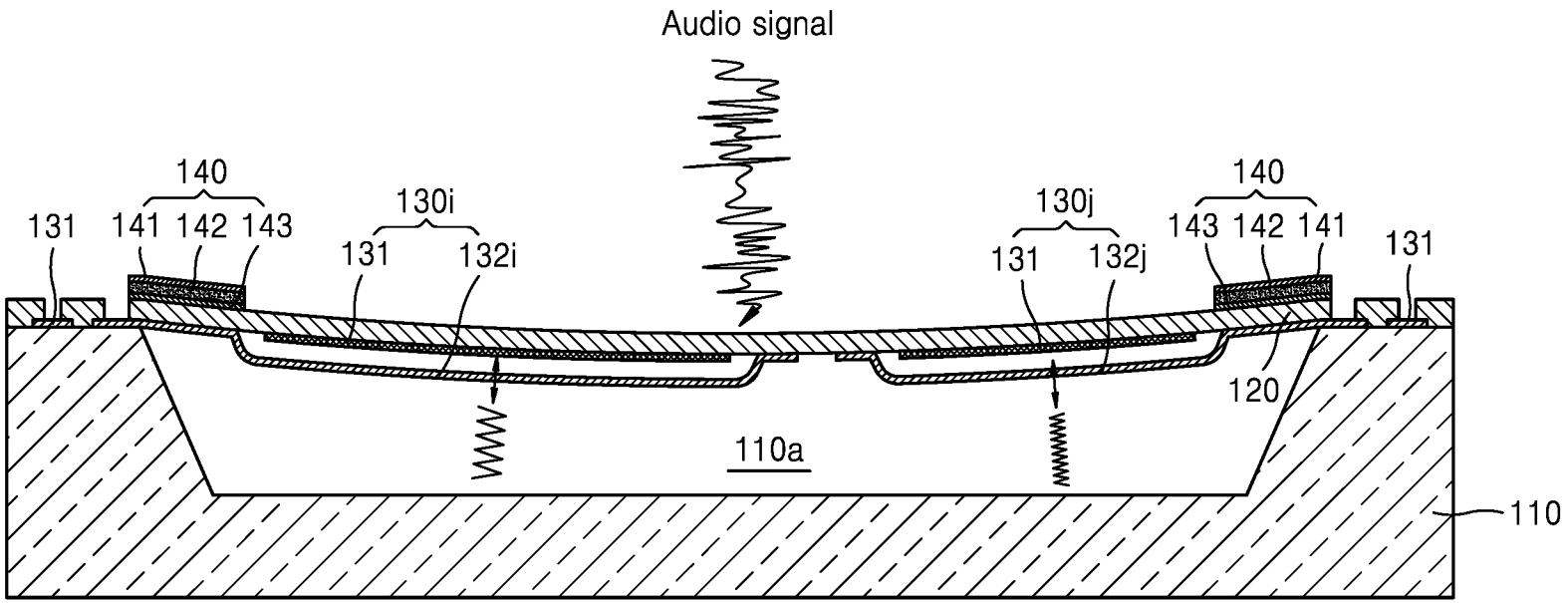
FIG. 6 is a cross-sectional view of the audio sensing device of FIG. 1 according to an exemplary embodiment.

FIG. 6 is a cross-sectional view of the audio sensing device 100 of FIG. 1 according to an exemplary embodiment. In FIG. 6, reference numerals 130*i* and 132*i* respectively denote an i-th resonator of the resonators 130 arranged on the membrane 120 and an i-th second electrode, and reference numerals 130*j* and 132*j* respectively denote a j-th resonator and a j-th second electrode. The i-th resonator 130*i* has a length that is longer than that of the j-th resonator 130*j*.

In the audio sensing device 100 of FIG. 6, when an external audio signal is input to the membrane 120, the membrane 120 vibrates in response to the input audio signal. The membrane 120 may receive an audio signal of a wide band. For example, the membrane 120 may receive an audio signal of an audible frequency range that is between about 20 Hz~about 20 kHz. As another example, the membrane 120 may receive an audio signal that has an ultrasonic frequency range of about 20 kHz or higher or an audio signal in an infrasonic frequency range of about 20 Hz or lower.

When the membrane 120 vibrates in response to the input audio signal, the resonators 130 arranged on the membrane 120 vibrates. For example, each of the second electrodes 132, vibrates at a predetermined frequency corresponding to the movement of the membrane 120. Accordingly, the resonators 130 that have different lengths from each other may sense sound frequencies of different bands. As illustrated in FIG. 6, because the i-th resonator 130*i* has a length longer than the j-th resonator 130*j*, the i-th resonator 130*i* vibrates at a lower frequency than the j-th resonator 130*j*. Accordingly, the i-th resonator 130*i* may sense a sound frequency of a first range among audio signals and the j-th resonator 130*j* may sense a sound frequency of a second range that is higher than the first range among the audio signals. Accordingly, when the resonators 130 having different lengths are arranged on the membrane 120, each of the resonators 130 may selectively sense a sound frequency of a range corresponding to each resonator 130.

Figure 7:
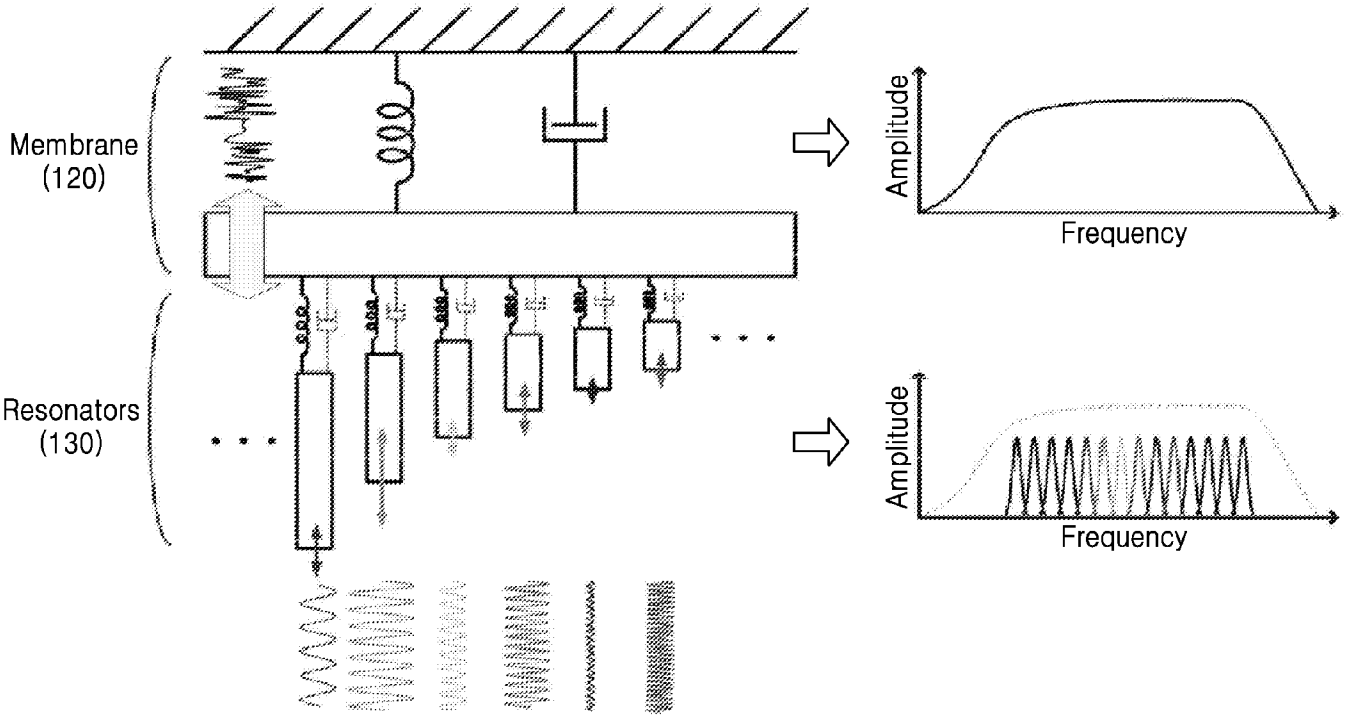
FIG. 7 is a view illustrating an operation of the audio sensing device of FIG. 1 according to an exemplary embodiment.

FIG. 7 is a view illustrating an operation of the audio sensing device 100 according to an exemplary embodiment.

Referring to FIG. 7, the membrane 120 vibrates as a predetermined audio signal is input, and the resonators 130 arranged on the membrane 120 vibrate according to the vibration of the membrane 120. The membrane 120 may vibrate at a frequency of a relatively wide band corresponding to an input audio signal, and each of the resonators 130 may vibrate at a resonant frequency of a relatively narrow band with respect to the wide band. Accordingly, each of the resonators 130 may selectively sense a sound frequency of different bands from each other. Frequency domain information of the audio signal input to the membrane 120 may be acquired by analyzing the selectively sensed sound frequencies of different bands.

For example, the audio sensing device 100 may sense vibrations of the membrane 120 only, and audio signal information of a wide band may be additionally or independently acquired. In this example, a piezoelectric method may be used as a method of sensing vibrations of the membrane 120 only. As illustrated in FIG. 6, the membrane 120 may be provided with a piezoelectric device 14 including two electrodes 141 and 143 and a piezoelectric element 142 interposed between the two electrodes 141 and 143. When the membrane 120 vibrates, the piezoelectric element 142 is deformed, and thus, the vibrations of only the membrane 120 may be sensed. As another example, the vibrations of the membrane 120 may be sensed using a capacitive method. A signal that is acquired by sensing the vibrations of the membrane 120 only is an audio signal that restores the sound input to the membrane 120, as illustrated in FIG. 6. The signal acquired by sensing the vibrations of the membrane 120 only may provide basic information about the original audio signal like an output of a general audio sensor such as a microphone. Accordingly, the audio sensing device 100 may acquire not only information about sound frequencies of different bands using the resonators 130, but also information about the original audio signal using the vibrations of the membrane 120 only.

According to the audio sensing device 100 of the exemplary embodiment, because a Fourier transformation process that consumes a large amount of electric power is removed, consumption of power may be greatly reduced. Instead, such a Fourier transformation function is embodied through a resonator array of a mechanical structure allowing power consumption to be greatly reduced. Accordingly, the frequency domain information of an audio signal may be monitored by the audio sensing device 100 using low power and at a fast speed in an always-ready state. Also, because resonators capable of sensing frequencies of various bands are manufactured to be very small through a micro-electro-mechanical system (MEMS) process, the resonators may be integrated in a small area.

In the above-described exemplary embodiment, resonators 130 are arranged on the membrane 120 and have different lengths from each other. However, the audio sensing device is not limited thereto and some of the resonators 130 may have the same length. For example, each pair of resonators may have the same length, and thus, sensitivity in sending a sound frequency of a predetermined band may be improved or otherwise increased.

Also, one or more exemplary embodiments the length among the dimensions of the resonators 130 may be changed in order to embody the sensing of the sound frequencies of different bands. As another example, it is possible to change the width and/or the thickness of a resonator to achieve the sensing of sound frequencies of different bands. In other words, resonators capable of sensing sound frequencies of different bands may be embodied by changing at least one of the length, width, and thickness of each of the resonators 130 arranged on the membrane 120. Although the frequency bands that resonators 130 receive are determined by the resonant frequency and the Q value that are determined according to the dimensions of the resonators 130, the amplitude of a signal of the frequency may vary according to positions of the resonators 130 on the membrane 120.

FIGS. 8A to 8E are plan views illustrating various examples of an array of the resonators 130 arranged on the membrane 120, according to exemplary embodiments.

Figure 8A:
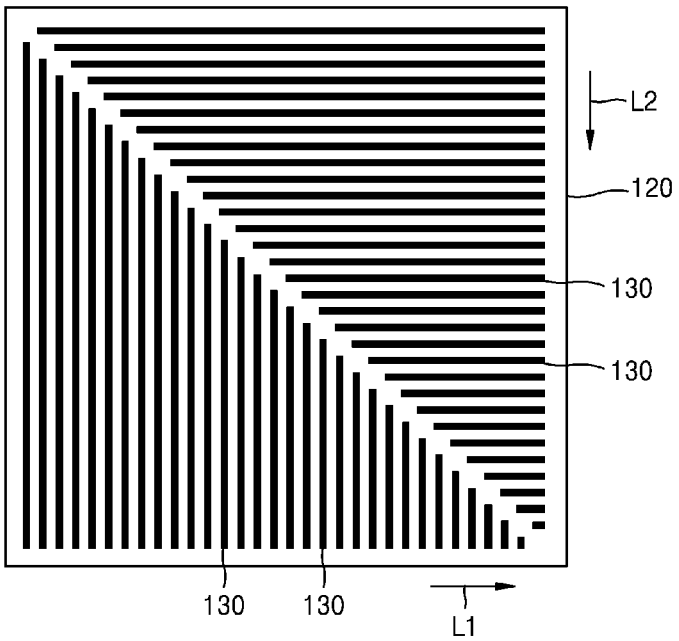
FIGS. 8A to 8E are plan views illustrating various modified examples of an array of resonators arranged on the membrane according to exemplary embodiments.

Referring to FIG. 8A, the resonators 130 are arranged on the membrane 120 in two dimensions. For example, the resonators 130 are arranged such that the lengths of the resonators 130 decrease in first and second directions L1 and L2 that are perpendicular to each other.

Figure 8B:
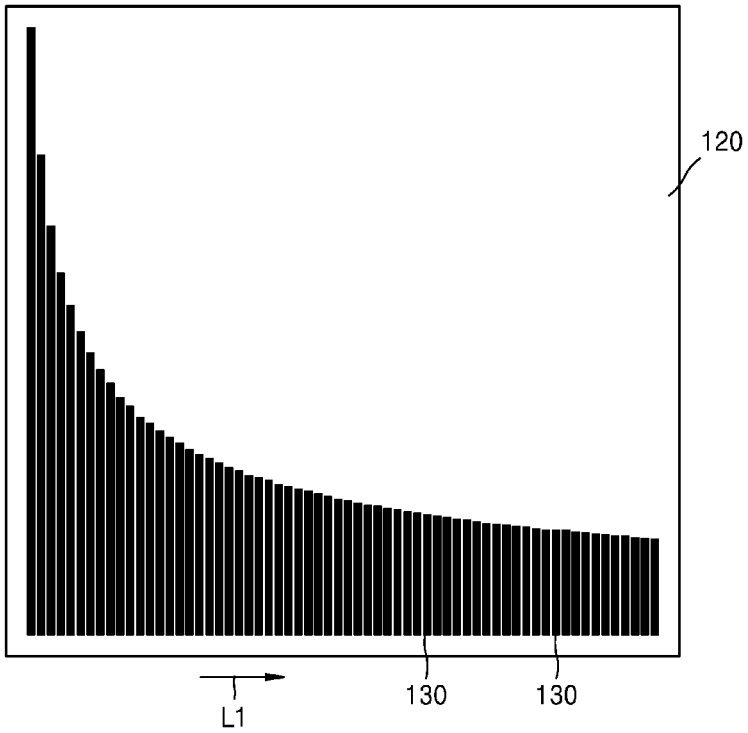

Referring to FIG. 8B, the resonators 130 are arranged on the membrane 120 in one dimension such that the lengths of the resonators 130 decrease in the first direction L1. For example, the resonators 130 may decrease exponentially in the first direction L1.

Figure 8C:
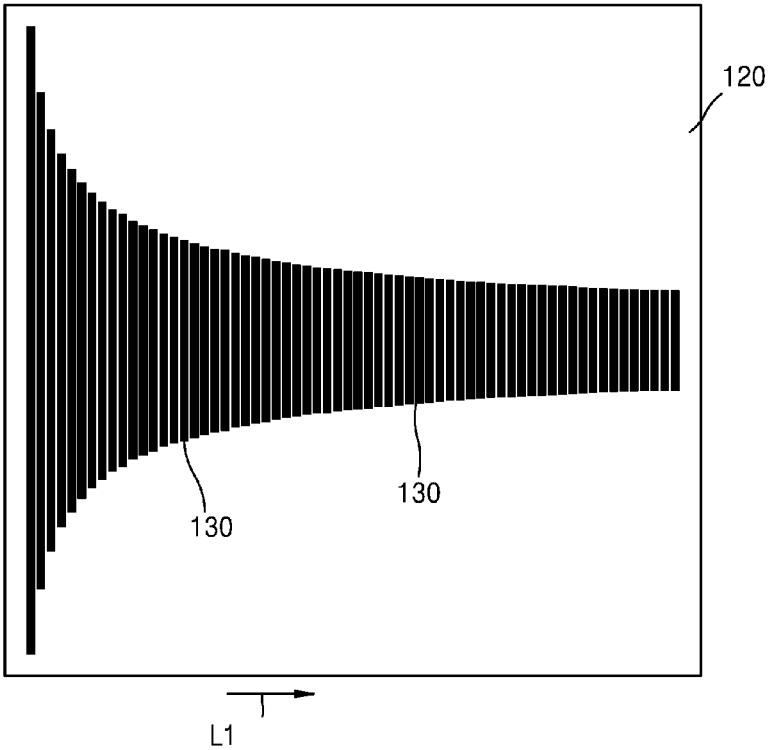

Referring to FIG. 8C, the resonators 130 are arranged on the membrane 120 in a vertical symmetry such that the lengths of the resonators 130 decrease in the first direction L1. In this example, the resonators 130 may exponentially decrease from a top and bottom thereof.

Figure 8D:
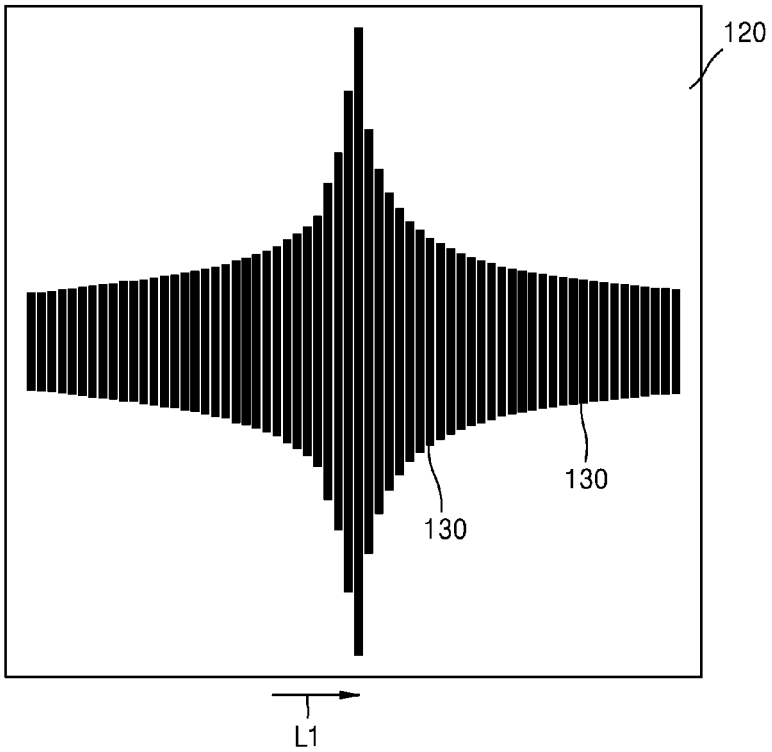

Referring to FIG. 8D, the resonators 130 are arranged on the membrane 120 in one dimension such that the lengths of the resonators 130 increase and then decrease in the first direction L1. In other words, the resonators 130 are arranged on the membrane 120 in a centralized form. In this example, the resonators 130 may exponentially increase from a left-farthest resonator 130 towards a central resonator 130, and then decrease exponentially from the central resonator 130 towards the right farthest resonator 130.

Figure 8E:
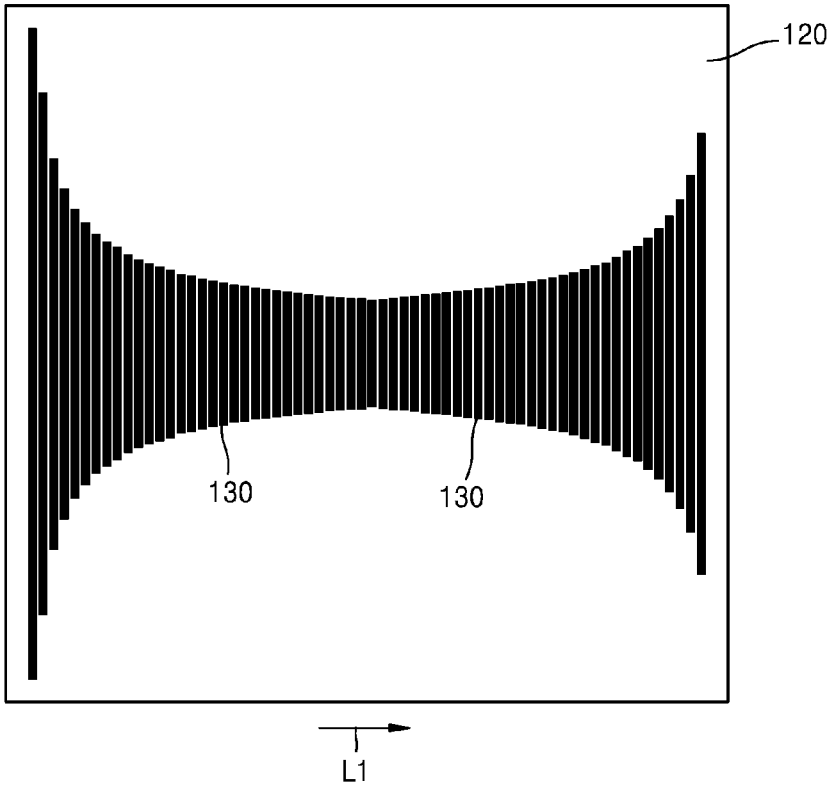

Referring to FIG. 8E, the resonators 130 are arranged on the membrane 120 in one dimension such that the lengths of the resonators 130 decrease and then increase in the first direction L1. In other words, the resonators 130 are arranged on the membrane 120 in a form of being distributed to left and right. In this example, the resonators 130 may exponentially decrease from a left-farthest resonator 130 towards a central resonator 130, and then increase exponentially from the central resonator 130 towards the right farthest resonator 130.

It should be appreciated that the arrangements of the resonators 130 in FIGS. 8A-8E are merely exemplarily. It should further be appreciated that in one or more exemplary embodiments, the resonators 130 may be arranged on the membrane 120 in variously forms of one dimension, two dimensions, or three dimensions. The resonators 130 may all have different lengths or some of the resonators 130 may have the same length. Also, the width and/or thickness of each of the resonators 130 may be variously modified. That is, one or more of the length, width, and thickness of the resonators 130 may be modified. Also, the placement of the resonators 130 may be modified.

Figure 9:
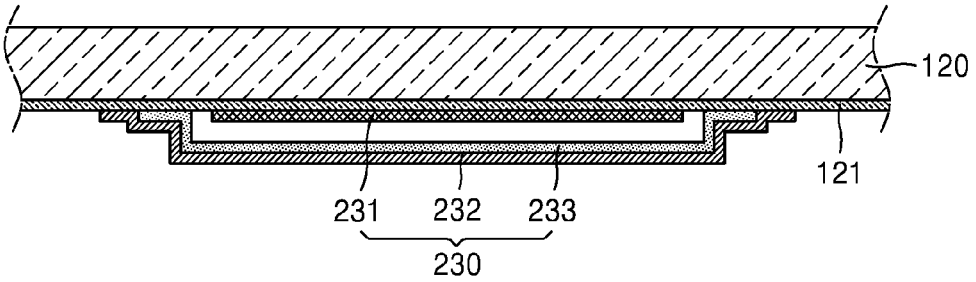
FIG. 9 is a cross-sectional view of a resonator according to another exemplary embodiment.

FIG. 9 is a cross-sectional view of a resonator 230 according to an exemplary embodiment.

Referring to FIG. 9, the resonator 230 may be an electro-static resonator that is provided on the membrane 120. In this example, a first insulating layer 121 is further formed on an inner surface of the membrane 120 where the resonator 230 is provided. When the membrane 120 includes a conductive material, the first insulating layer 121 may insulate the membrane 120 from the resonator 230. Accordingly, when the membrane 120 is formed of an insulating material, the first insulating layer 121 may not be included.

The resonator 230 may include first and second electrodes 231 and 232 that are spaced apart from each other, and a second insulating layer 233 that is provided on a surface of the second electrode 232 and that faces the first electrode 231. The second insulating layer 233 prevents the first electrode 231 and the second electrode 232 from electrically contacting each other. Although FIG. 9 exemplarily illustrates an example in which the second insulating layer 233 is formed only on the second electrode 232, the second insulating layer may be formed on the first electrode 231 or on both of the first and second electrodes 231 and 232. Also, the resonator 230 may be manufactured in a fine size by the MEMS process.

Figure 10:
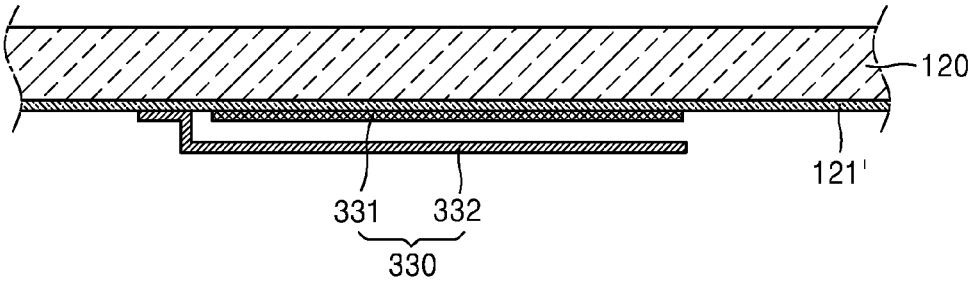
FIG. 10 is a cross-sectional view of a resonator according to another exemplary embodiment.

FIG. 10 is a cross-sectional view of a resonator 330 according to another exemplary embodiment.

Referring to FIG. 10, the resonator 330 may be an electro-static resonator that is provided on the membrane 120. In this example, an insulating layer 121' is formed on the inner surface of the membrane 120 where the resonator 330 is provided. One end of a second electrode 332 that is spaced apart from a first electrode 331 is fixed on the membrane 120 and the other end of the second electrode 332 is spaced apart from the first electrode 331 without being fixed to the membrane 120.

Figure 11:
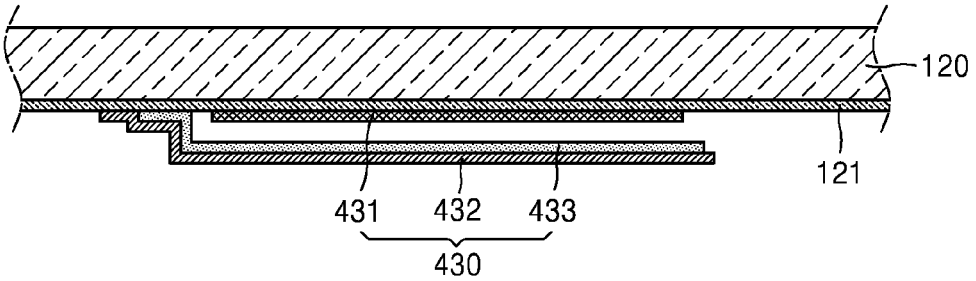
FIG. 11 is a cross-sectional view of a resonator according to another exemplary embodiment.

FIG. 11 is a cross-sectional view of a resonator 430 according to another exemplary embodiment. In the resonator 430 of FIG. 11, unlike the resonator 230 of FIG. 9, one end of a second electrode 432 and one end of a second insulating layer 433 are fixed to the membrane 120 and the other respective ends thereof are spaced apart from a first electrode 431 without being fixed on the membrane 120.

Figure 12:
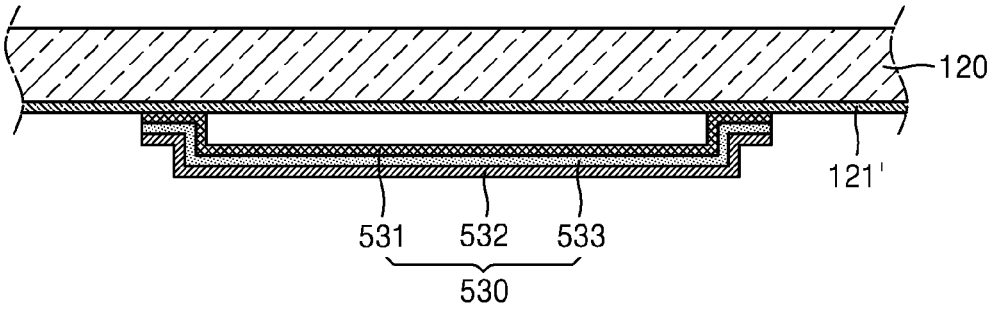
FIG. 12 is a cross-sectional view of a resonator according to another exemplary embodiment.

FIG. 12 is a cross-sectional view of a resonator 530 according to another exemplary embodiment. Referring to FIG. 12, the resonator 530 may be a piezoelectric resonator that is provided on the membrane 120.

In this example, the resonator 530 includes first and second electrodes 531 and 532 that are spaced apart from each other and a piezoelectric layer 533 that is provided between the first and second electrodes 531 and 532. Opposite ends of the first electrode 531 are fixed to the inner surface of the membrane 120 and a center portion of the first electrode 531 is spaced apart from the membrane 120. The piezoelectric layer 533 includes a piezoelectric material that may generate electric energy through deformation. For example, the piezoelectric layer 533 may include ZnO, SnO, PZT, $ZnSnO_3$, polyvinylidene fluoride (PVDF), poly(vinylidene fluoride-trifluoroethylene) (P(VDF-TrFE)), AlN, or PMN-PT. However, the exemplary embodiments are not limited thereto and the piezoelectric layer 533 may include various other piezoelectric materials.

In the resonator 530 of a piezoelectric resonator type, when the resonator 530 vibrates according to the movement of the membrane 120, the piezoelectric layer 533 provided between the first and second electrodes 531 and 532 may be deformed. In response to the piezoelectric layer 533 being deformed, an electrical signal may be detected from the first and second electrodes 531 and 532. Accordingly, the resonator 530 may selectively sense a sound frequency of a particular band. Furthermore, the frequency band that the resonator 530 may sense may be adjusted by adjusting at least one of the length, width, and thickness of the resonator 530.

Figure 13:
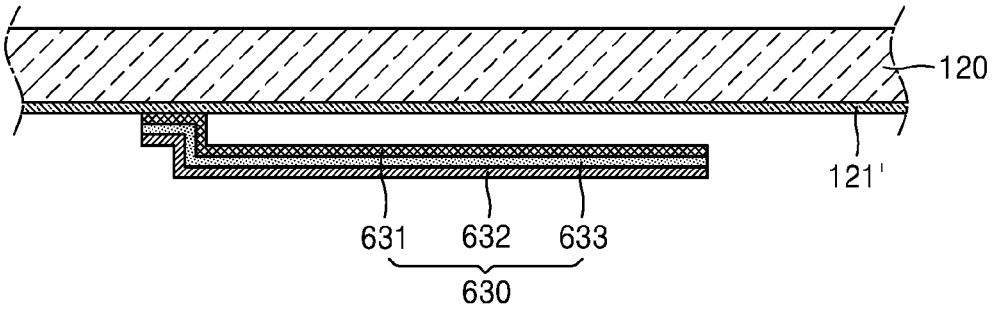
FIG. 13 is a cross-sectional view of a resonator according to another exemplary embodiment.

FIG. 13 is a cross-sectional view of a resonator 630 according to another exemplary embodiment. In the resonator 630 of FIG. 13, unlike the resonator 530 of FIG. 12, one end of a first electrode 631, a second electrode 632, and a piezoelectric layer 633 are fixed and the membrane 120 and the other respective ends thereof are spaced apart from the membrane 120 without being fixed on the membrane 120.

Figure 14A:
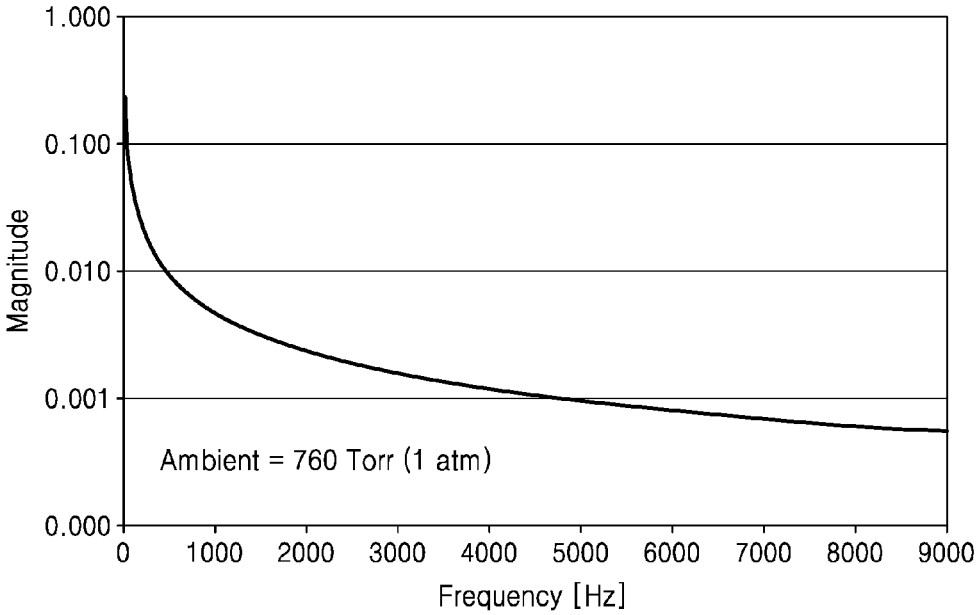
FIGS. 14A and 14B are graphs illustrating behaviors of the resonators when the ambient pressures of the resonators are respectively set to about 760 Torr and about 100 mTorr, in the audio sensing device of FIG. 1 according to exemplary embodiments.
Figure 14B:
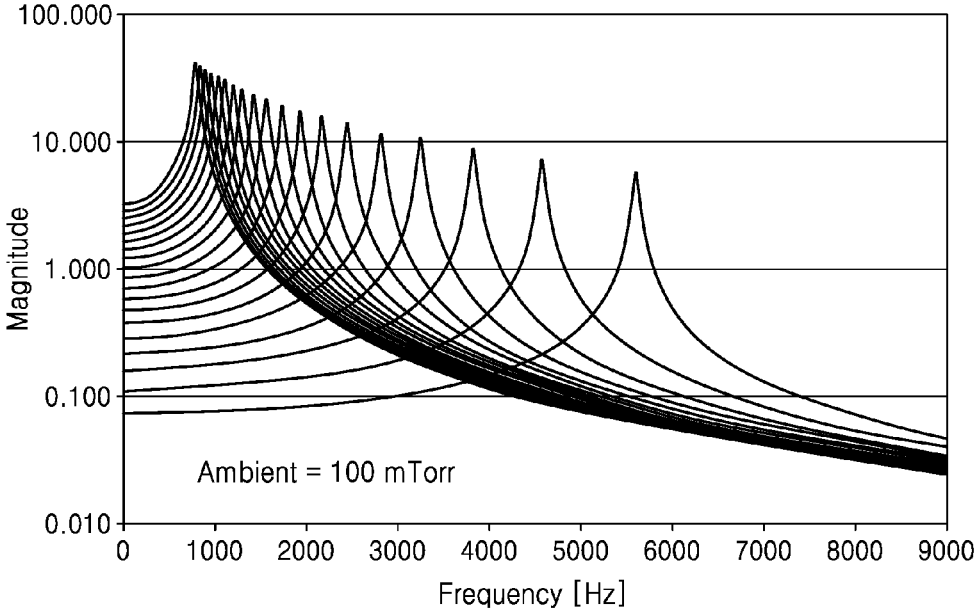

FIGS. 14A and 14B are graphs illustrating behaviors of the resonators 130 according to ambient pressures in the audio sensing device 100 of FIG. 1, according to exemplary embodiments. For example, FIG. 14A illustrates behaviors of the resonators 130 when the ambient pressure of the resonators 130 are set to about 760 Torr (1 atm), in the audio sensing device 100 of FIG. 1. FIG. 14B illustrates behaviors of the resonators 130 when the ambient pressure of the resonators 130 are set to about 100 mTorr.

Referring to FIG. 14A, when the ambient pressure of the resonators 130 is set to about 760 Torr (1 atm), the resonators 130 hardly have a frequency resolution on the audio signal input to the membrane 120 due to large damping. Referring to FIG. 14B, when the ambient pressure of the resonators 130 is set to about 100 mTorr, the Q factor of the resonators 130 is improved and the audio signal input to the membrane 120 may be separated into frequencies that have specific bandwidths. As such, in the audio sensing device 100 according to the present exemplary embodiment, to selectively sense frequencies of different bands, the interior of the cavity 110*a* in which the resonators 130 are disposed may be maintained in a vacuum state that is lower than the atmospheric pressure. For example, the interior of the cavity 110*a* formed in the substrate 110 may be maintained at a pressure of about 100 Torr or lower. As a non-limiting example, the interior of the cavity 110*a* may be maintained at a pressure of about 1000 mTorr or lower. However, the present exemplary embodiment is not limited thereto.

FIGS. 15A to 15D are graphs illustrating behaviors of the resonators 130 according to a change in the lengths of the resonators 130, in the audio sensing device 100 of FIG. 1.

Figure 15A:
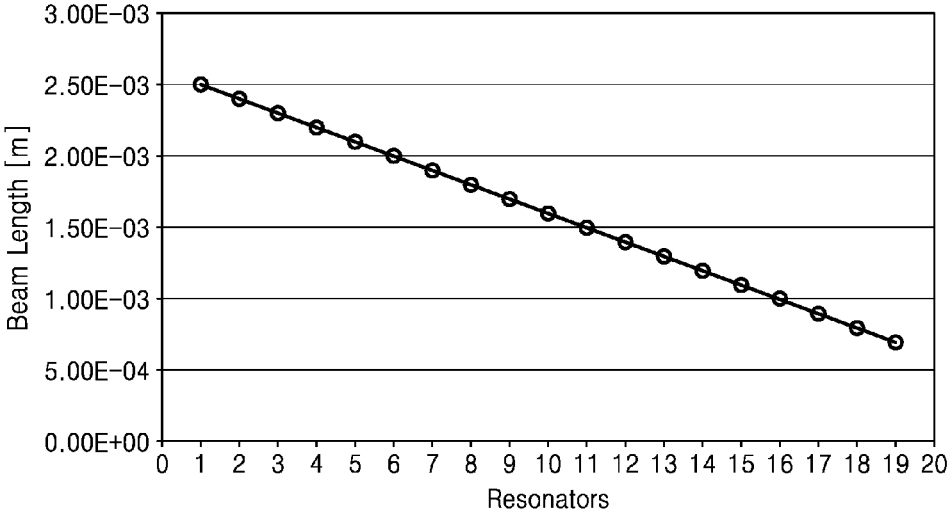
FIGS. 15A to 15D are graphs illustrating behaviors of the resonators according to a change in the length of each resonator, in the audio sensing device of FIG. 1, according to exemplary embodiments.
Figure 15B:
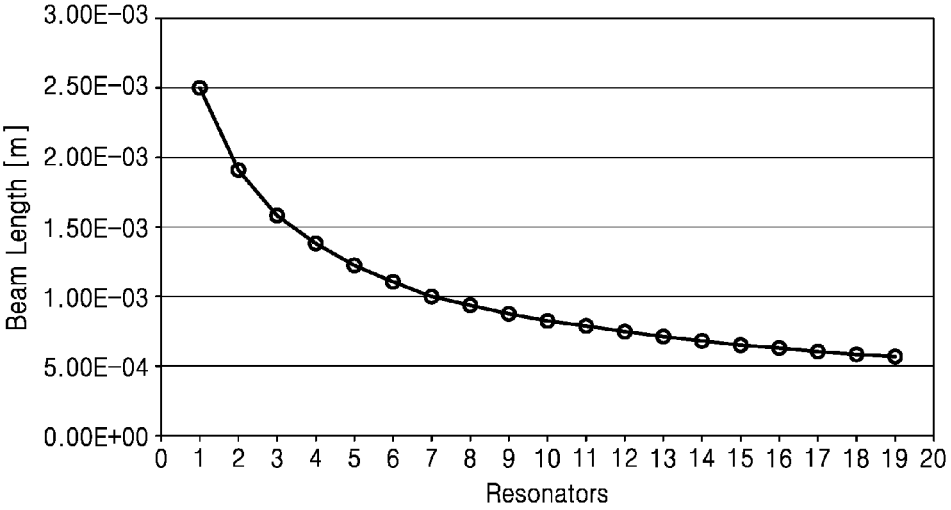
Figure 15C:
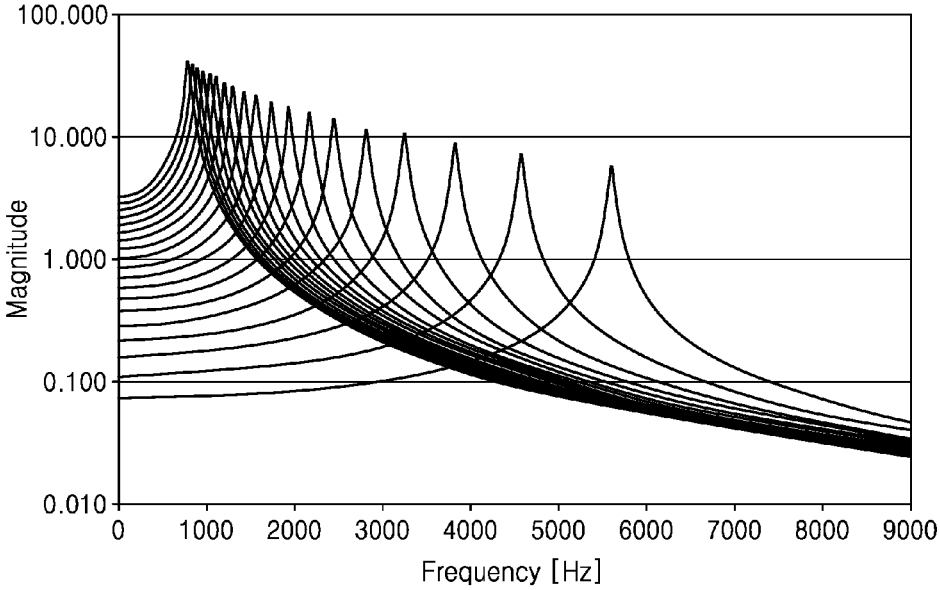
Figure 15D:
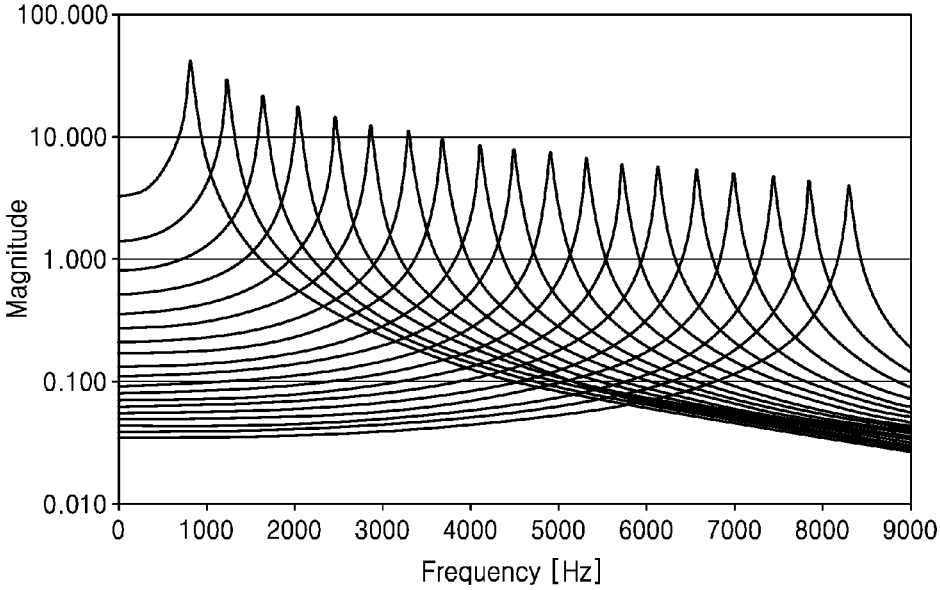

FIGS. 15A and 15B illustrate changes in lengths of the resonators 130 of the audio sensing device 100 FIG. 1. A beam length on a Y axis denotes the length of each of the resonators 130. When the resonators 130 have a constant length change in a linear shape as illustrated in FIG. 15A, the behaviors of the resonators 130 may be that as illustrated in FIG. 15C. As another example, when the resonators 130 have an inconsistent length change in a curved shape as illustrated in FIG. 15B, the behaviors of the resonators 130 are as illustrated in FIG. 15D. FIGS. 15C and 15D illustrate the behaviors of the resonators in examples in which the ambient pressure is set to about 100 mTorr.

Referring to FIG. 15C, the resonators 130 having the length change in the shape as illustrated in FIG. 15A do not have resonant frequencies that are spaced apart from each other at constant intervals. In contrast, referring to FIG. 15D, the resonators 130 having the length change in the shape as illustrated in FIG. 15B have resonant frequencies that are spaced apart from each other at constant intervals. Accordingly, the intervals between the resonant frequencies may be adjusted in a variety of ways such as equal intervals, geometric intervals, harmonic intervals, and the like, by changing the lengths of the resonators 130.

Figure 16A:
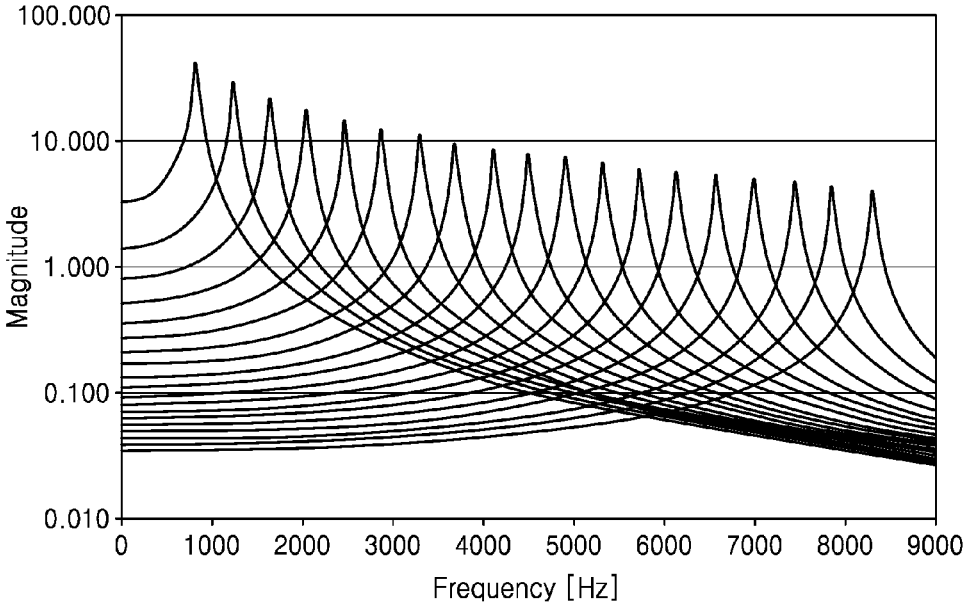
FIGS. 16A and 16B are graphs respectively illustrating behaviors of the resonators before and after gain adjustment, in the audio sensing device of FIG. 1, according to exemplary embodiments.
Figure 16B:
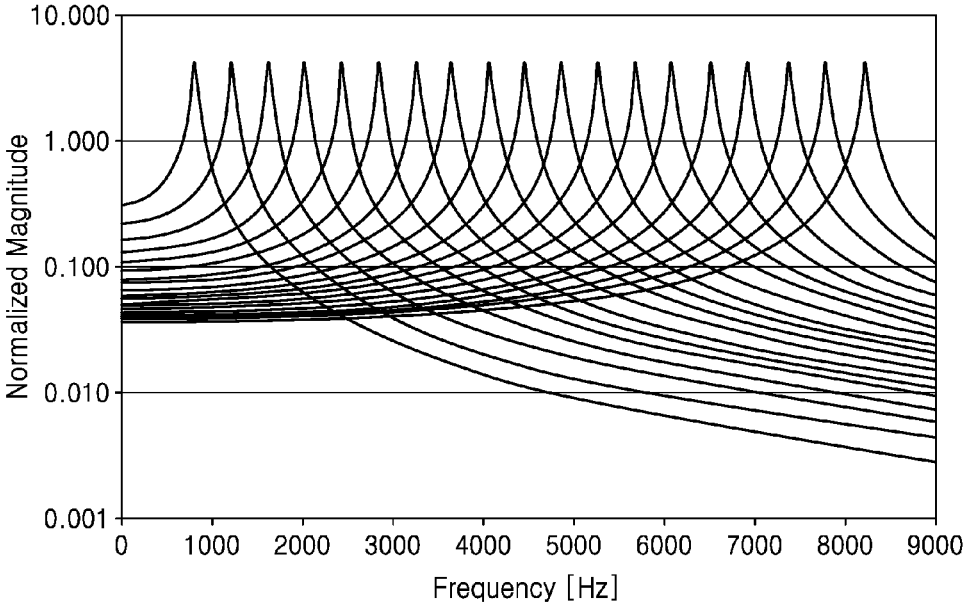

FIGS. 16A and 16B are graphs respectively illustrating behaviors of the resonators 130 before and after gain adjustment, in the audio sensing device 100 of FIG. 1. For example, FIG. 16A illustrates behaviors of the resonators 130 before gain adjustment and FIG. 16B illustrates behaviors of the resonators 130 after the gain adjustment.

As illustrated in FIG. 16A, prior to the gain adjustment, the resonators 130 may have signals that have different magnitudes at respective resonant frequencies, but after the gain adjustment, the resonators 130 may output signals that have the same amplitude at the respective resonant frequencies as illustrated in FIG. 16B. Accordingly, the amplitudes of the output signals at the resonant frequencies of the resonators 130 may be adjusted to be identical through the gain adjustment.

Figure 17A:
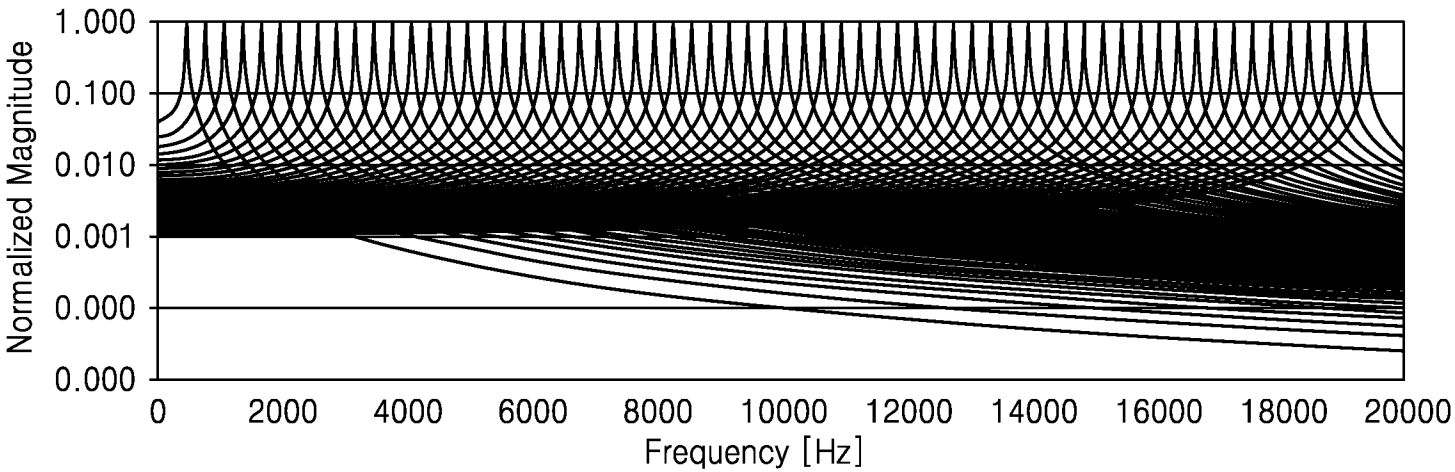
FIGS. 17A to 17C are graphs illustrating behaviors of the resonators having resonance frequencies at equal intervals, in the audio sensing device of FIG. 1, according to exemplary embodiments.

FIG. 17A illustrates behaviors of the resonators 130 having resonance frequencies at an equal interval, in the audio sensing device 100 of FIG. 1. For example, FIG. 17A illustrates an example in which the sixty-four (64) resonators 130 are arranged such that the resonant frequencies have equal intervals between about 500 Hz~about 20 kHz. The ambient pressure of the resonators 130 is about 100 mTorr, and the width and thickness of each of the resonators 130, for example, the width and the thickness of each of the second electrodes 132, are respectively about 5 μm and about 0.5 μm. The lengths of the resonators 130, for example, the lengths of the second electrodes 132, may be about 0.2 mm~about 0.8 mm. In the resonators 130, the gap between the first electrode 131 and the second electrodes 132 is set to about 0.5 μm.

Figure 17B:
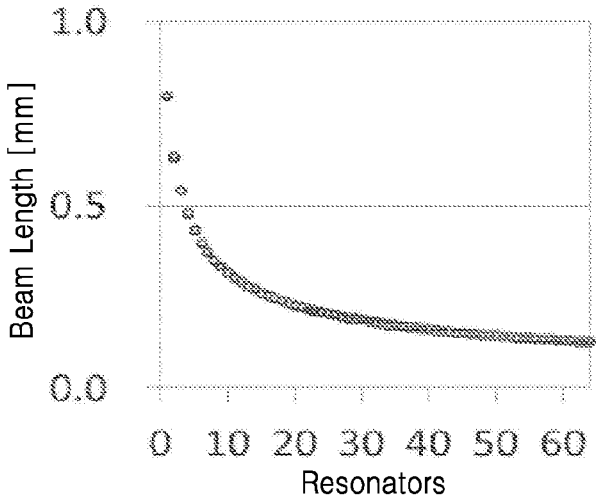
Figure 17C:
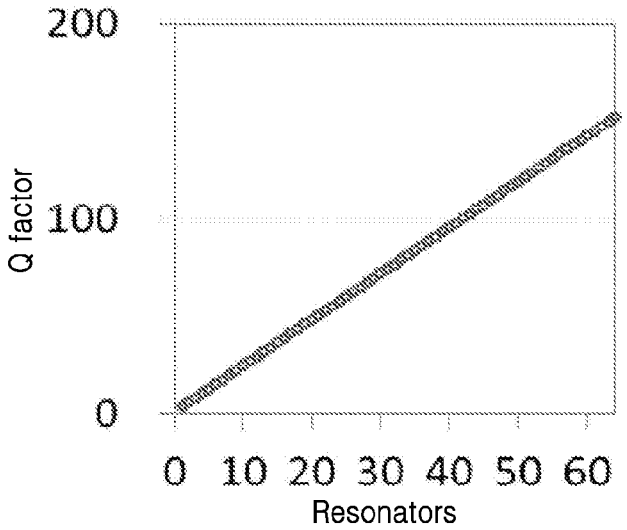

FIG. 17B illustrates a change in the lengths of the resonators 130 of FIG. 17A, and FIG. 17C illustrates a change in the Q factors of the resonators 130 of FIG. 17A. In FIG. 17B, a beam length denotes the length of each of the resonators 130, for example, the length of each of the second electrodes 132. When the resonators 130 have the length change as illustrated in FIG. 17B and the Q factor change as illustrated in FIG. 17C, the resonant frequencies may be arranged at constant intervals as illustrated in FIG. 17A and the bandwidth may be maintained as a constant.

Figure 18A:
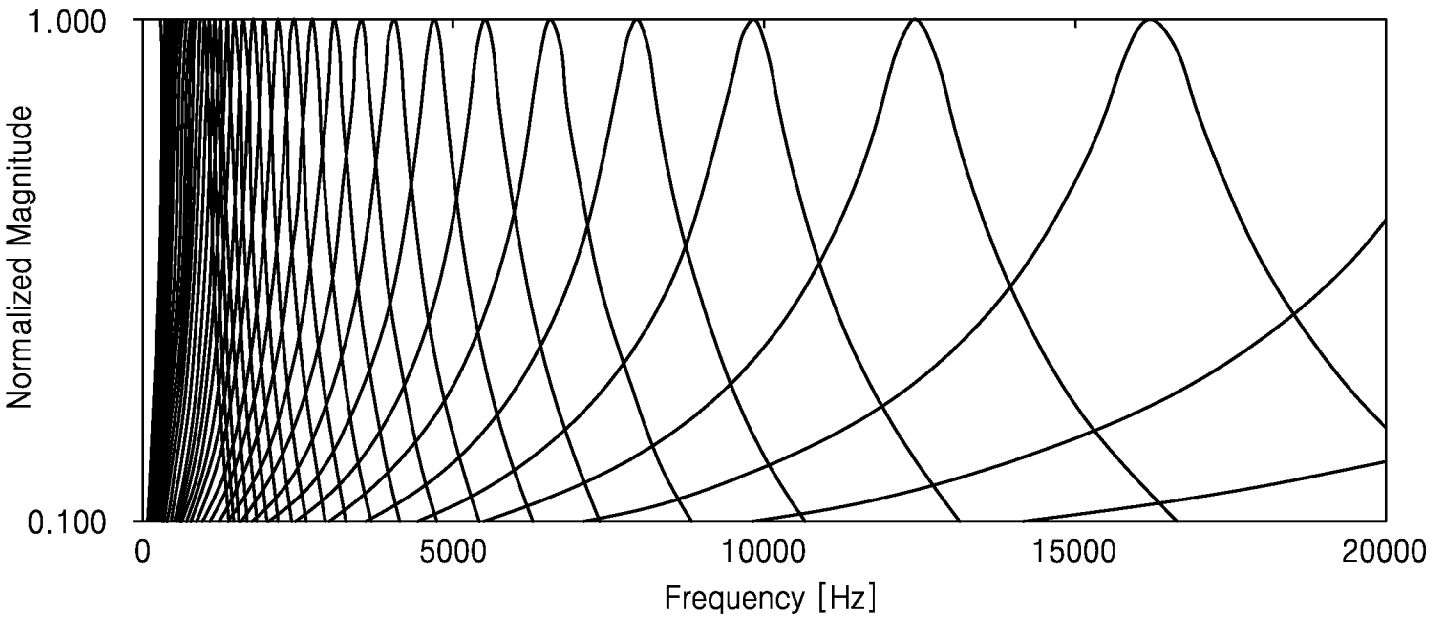
FIGS. 18A to 18E are graphs illustrating behaviors of the resonators having resonance frequencies at unequal intervals, in the audio sensing device of FIG. 1, according to exemplary embodiments.

FIG. 18A illustrates behaviors of the resonators 130 having resonant frequencies at unequal intervals in the audio sensing device 100 of FIG. 1, according to an exemplary embodiment. For example, FIG. 18A illustrates an example in which forty-five (45) resonators 130 are arranged such that the resonant frequencies have unequal intervals, for example, a gamma-tone shape, between about 300 Hz about 20 kHz. In this example, the ambient pressure of the resonators 130 is set to about 100 mTorr, and the thickness of the resonators 130 is set to 0.5 μm. The length of each of the resonators 130 is set to about 0.2 mm~about 0.8 mm, and the width of each of the resonators 130 is set to about 2.5 μm~about 25 μm. Also, in the resonators 130, the gap between the first electrode 131 and the second electrodes 132 is set to about 0.5 μm.

Figure 18B:
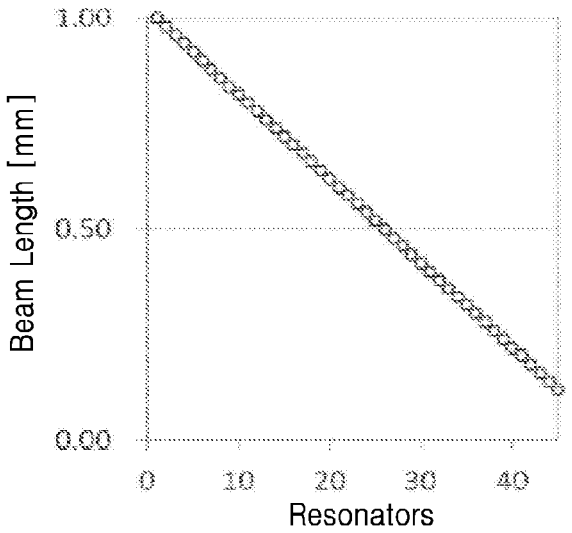
Figure 18C:
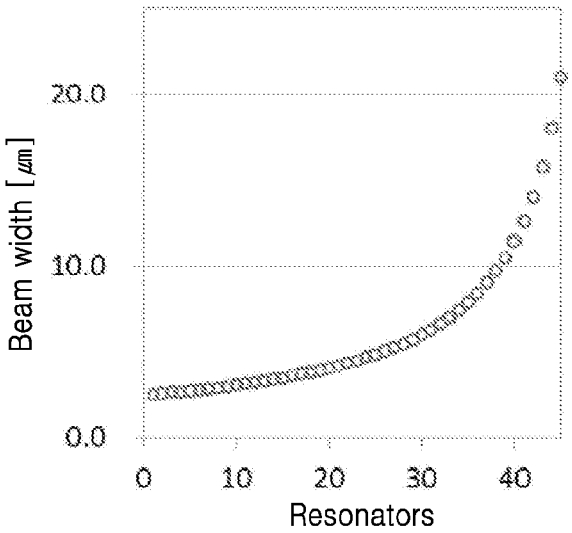
Figure 18D:
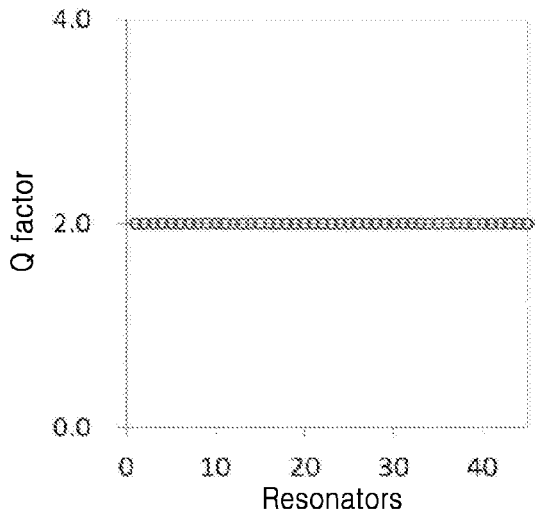
Figure 18E:
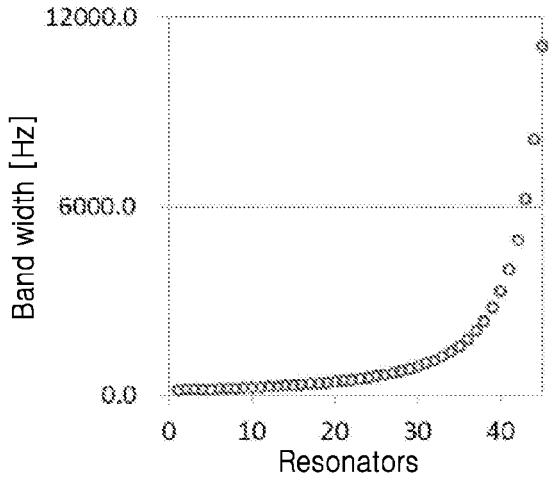

FIGS. 18B and 18C respectively illustrate the length change and the width change of the resonators 130 of FIG. 18A. In these examples, the beam length and the beam width denote the length and width of each of the resonators 130, for example, the length and width of each of the second electrodes 132. FIG. 18D illustrates an example of a change in the Q factor of the resonators 130 of FIG. 18A. FIG. 18E illustrates an example of a bandwidth of each of the resonators 130 of FIG. 18A.

In FIG. 18D, the resonators 130 have a constant Q factor and the resonant frequencies are arranged with unequal intervals, for example, in a gamma-tone shape, when the resonators 130 have the length change and the width change as illustrated in FIGS. 18B and 18C. Also, the bandwidths of the resonant frequencies gradually increase as the intervals between the resonant frequencies increase as illustrated in FIG. 18E.

Figure 19A:
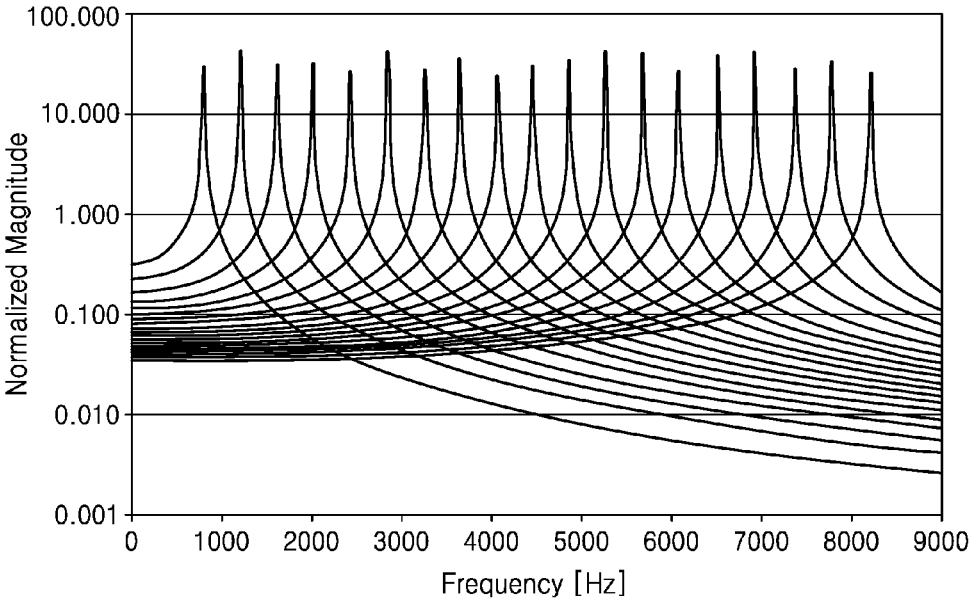
FIGS. 19A to 19C are graphs illustrating behaviors of the resonators according to ambient pressures of the resonators, in the audio sensing device of FIG. 1, according to exemplary embodiments.
Figure 19B:
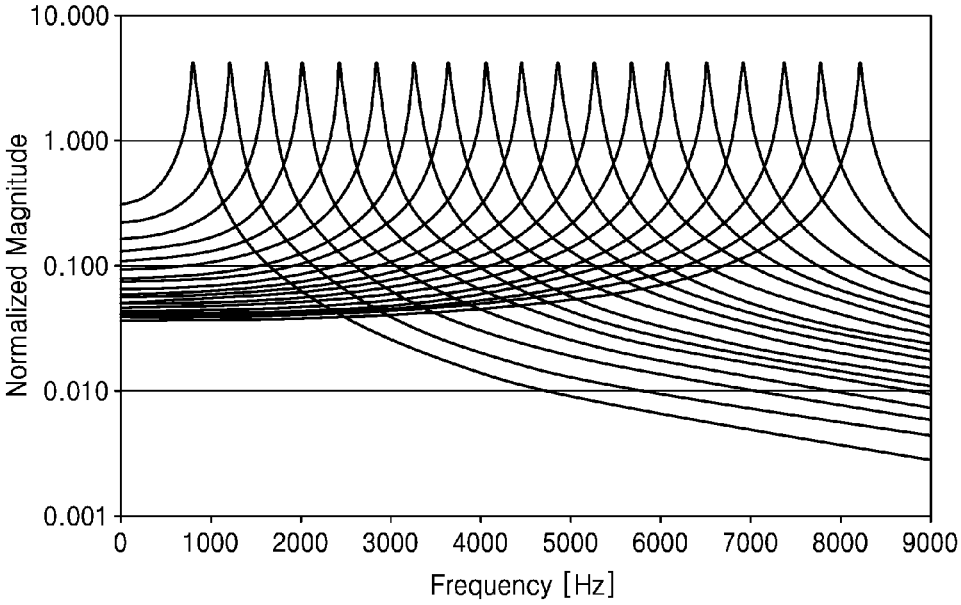
Figure 19C:
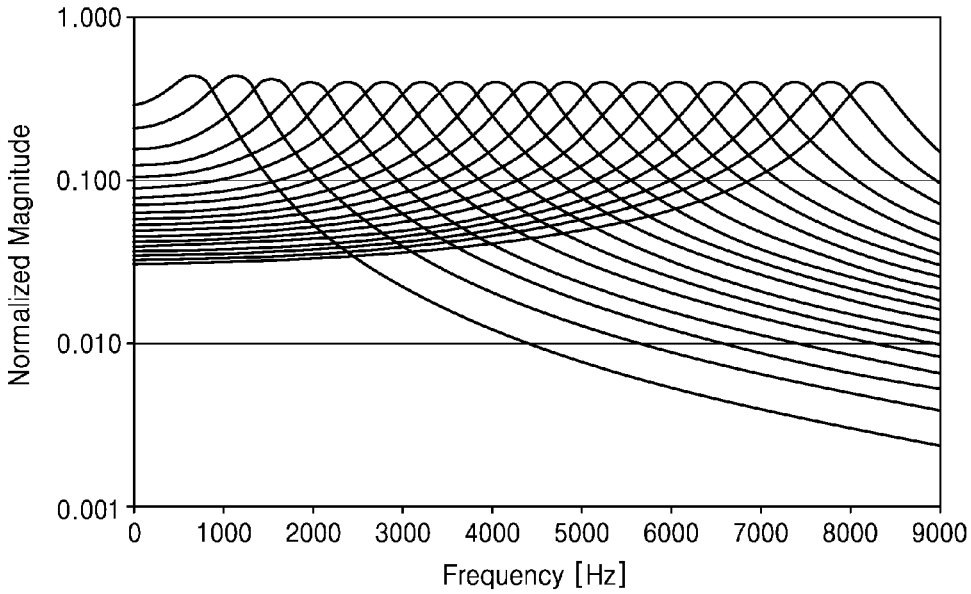

FIGS. 19A to 19C are graphs illustrating behaviors of the resonators 130 according to the ambient pressures of the resonators 130, in the audio sensing device 100 of FIG. 1, according to exemplary embodiments.

Figure 19D:
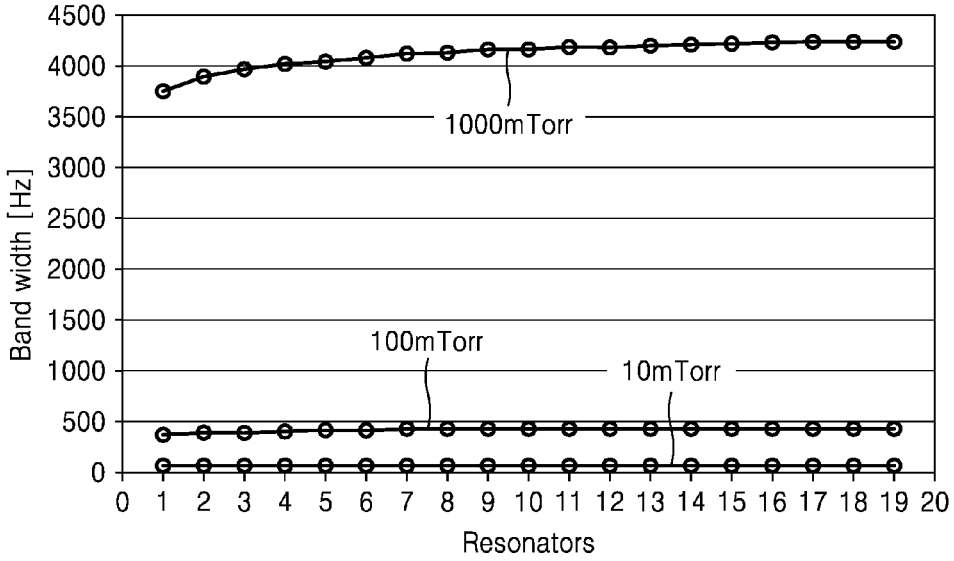
FIG. 19D is a graph illustrating a result of bandwidth comparison among the resonators of FIGS. 19A to 19C according to an exemplary embodiment.

FIGS. 19A to 19C illustrate the behaviors of the resonators 130 after gain adjustment. For example, FIG. 19A illustrates the behaviors of the resonators 130 when the ambient pressure of the resonators 130 is about 10 mTorr in the audio sensing device 100. FIG. 19B illustrates the behaviors of the resonators 130 when the ambient pressure of the resonators 130 is about 100 mTorr. FIG. 19C illustrates the behaviors of the resonators 130 when the ambient pressure of the resonators 130 is about 1000 mTorr. FIG. 19D is a graph illustrating a result of a bandwidth comparison among the resonators 130 of FIGS. 19A to 19C.

Referring to FIG. 19D, the frequency bandwidths of the resonators 130 are largest when the ambient pressure is about 1000 mTorr as illustrated in FIG. 19C, and the frequency bandwidths of the resonators 130 are smallest when the ambient pressure is about 10 mTorr as illustrated in FIG. 19A. Accordingly, the frequency bandwidths of the resonators 130 decrease as the ambient pressure decreases.

In other words, the Q factor of the resonators 130 increases as the ambient pressure decreases. Accordingly, a frequency selectivity of the resonators 130 may be enhanced as the ambient pressure decreases.

The above-described frequency behaviors illustrated in FIGS. 14A to 19D are non-limiting examples as a result of simulating the audio sensing device 100 and describe a method of acquiring information about an audio signal as the resonators 130 selectively sense frequencies of different bands from each other when an audio signal of a predetermined band is input to the membrane 120.

As described above, in one or more exemplary embodiments, information about an audio signal of a wide band may be additionally or independently acquired by sensing the vibrations of the membrane 120 only. The signal acquired by sensing the vibrations of the membrane 120 only may be an audio signal that restores the sound input to the membrane 120 as it is, as illustrated in FIG. 6. The signal acquired by sensing the vibrations of the membrane 120 only may provide basic information about the original audio signal like an output of a general audio sensor such as a microphone.

A method of acquiring frequency domain information with respect to an audio signal using the above-described audio sensing device will now be described with reference to FIG. 20.

Figure 20:
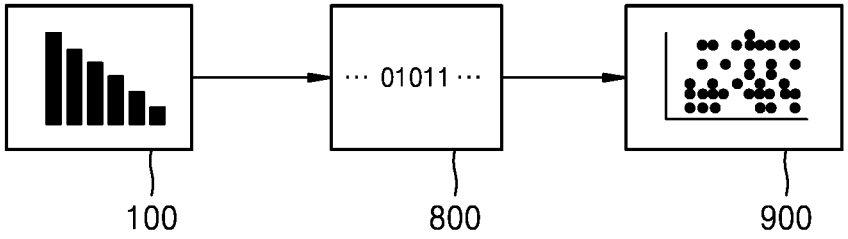
FIG. 20 is a diagram illustrating a method of acquiring a frequency using an audio sensing device according to an exemplary embodiment.

Referring to FIG. 20, when a predetermined audio signal is input to the audio sensing device 100, each of the resonators 130 of FIG. 1 selectively senses a frequency of a predetermined band. Next, the frequencies of different bands that are selectively sensed by the resonators 130 are normalized by, for example, an analog-to-digital converter (ADC) 800. However, in this example, the ADC 800, does not need to separate the audio signal into a plurality of different frequency bands through a Fourier transform because the plurality of resonators have already sensed the frequencies of the plurality of different bands. Rather, prior to the signal being converted from an analog signal to a digital signal, the different frequency bands are sensed by the audio sensing device 100.

A spectrogram 900 is obtained using the normalized frequency information, and thus, frequency domain information with respect to the audio signal input to the audio sensing device 100 may be acquired. Although in the above description a case in which only the resonators 130 provided on the membrane 120 selectively senses frequencies of predetermined bands is described, a process of collecting information about an audio signal of a wide band by sensing the vibrations of the membrane 120 only generated by the input audio signal may be added. For example, piezoelectric type sensing may be used as the method for sensing the vibrations of the membrane 120 only. However, the exemplary embodiments are not limited thereto and capacitive type sensing may be used as another example. Also, the information about the audio signal input to the audio sensing device 100 may be independently collected by sensing the vibrations of the membrane 120 only.

According to the above exemplary embodiments, as a plurality of resonators provided in an audio sensing device may selectively sense sound frequencies of predetermined bands, and frequency domain information with respect to an audio signal that is externally input may be easily acquired. In the above audio sensing device, because a Fourier transformation process that consumes a large amount of electric power is removed, and such a Fourier transformation function is embodied through a resonator array of a mechanical structure, consumption of power may be greatly reduced. Also, because a signal is output in a direct response to an external audio signal, frequency domain information may be quickly acquired. Accordingly, the frequency domain information of an audio signal may be monitored in real time with low power and at a fast speed in an always-ready state. Furthermore, noise generated nearby may be effectively removed. Also, because the resonators may be manufactured to be very small on the membrane through a micro-electro-mechanical system (MEMS) process, many resonators for selectively sensing frequencies of many various bands may be integrated in a small area.

The audio sensing device configured as described above according to one or more exemplary embodiments may be applied to a variety of fields. For example, the audio sensing device may be applied to the fields of voice recognition and control. In this example, as the audio sensing device recognizes a voice of a speaker, apparatuses or mobile devices in a home or in a vehicle may be operated or unlocked.

Also, the audio sensing device may be applied to a field of context awareness. In this example, the audio sensing device may analyze sound generated nearby and determine information about an environment surrounding a user. Accordingly, the user may be provided with information appropriate for the environment which may help the user effectively carry out a job.

As another example, the audio sensing device may be applied to a field of reducing noise or improving call quality. In this example, call quality may be improved or a voice recognition rate may be improved by always monitoring a state of noise generated nearby through the audio sensing device and removing the noise in advance during call or according to a voice command. In addition, the audio sensing device may be applied to a variety of fields such as a hearing aid requiring high performance and long battery life, and a field of sensing premises risk such as falling, injury, object drop, intrusion, screaming, and the like.

What is claimed is:

1. An audio sensing device comprising:
- a substrate having a cavity formed therein;
- a membrane provided on the substrate and entirely covering an opening of the cavity; and
- a plurality of resonators disposed on the membrane and between a bottom surface of the cavity and the membrane, and respectively configured to sense sound frequencies of different frequency bands,
- wherein each of the plurality of resonators comprises:
  - a first electrode provided on the membrane; and
  - a second electrode fixedly provided on the membrane and spaced apart from the first electrode.

2. The audio sensing device of claim 1, wherein the plurality of resonators are disposed inside the cavity and the interior of the cavity is maintained in a vacuum state.

3. The audio sensing device of claim 2, wherein a degree of vacuum in the cavity is less than or equal to 100 Torr.

4. The audio sensing device of claim 1, wherein the plurality of resonators are arranged on the membrane in one dimension or two dimensions.

5. The audio sensing device of claim 1, wherein a number of the plurality of resonators is in a range of ten to thousand.

6. The audio sensing device of claim 1, wherein the second electrode comprises a boundary area that is fixed on and in contact with the membrane, and a center area that is spaced apart from the membrane.

7. The audio sensing device of claim 1, wherein the first electrode is a common electrode.

8. The audio sensing device of claim 1, further comprising an insulating layer interposed between the membrane and the first electrode.

9. The audio sensing device of claim 1, wherein each of the plurality of resonators further comprises an insulating layer interposed between the first electrode and the second electrode and provided on one of the first electrode and the second electrode.

10. The audio sensing device of claim 1, wherein the first and second electrodes comprise a conductive material.

11. The audio sensing device of claim 1, wherein each of the plurality of resonators comprises:

a piezoelectric layer interposed between the first electrode and the second electrode.

12. The audio sensing device of claim 11, wherein one end or opposite ends of the first electrode are fixed on the membrane.

13. The audio sensing device of claim 11, further comprising an insulating layer interposed between the membrane and the first electrode.

14. The audio sensing device of claim 11, wherein the piezoelectric layer comprises at least one of ZnO, SnO, PZT, $ZnSnO_3$, polyvinylidene fluoride (PVDF), poly(vinylidene fluoride-trifluoroethylene) (P(VDF-TrFE)), AlN, and PMN-PT.

15. The audio sensing device of claim 11, wherein the first and second electrodes comprise a conductive material.

16. The audio sensing device of claim 1, wherein at least two of the plurality of resonators are configured to sense sound frequencies of a same band.

17. The audio sensing device of claim 1, wherein the substrate comprises silicon.

18. The audio sensing device of claim 1, wherein the membrane comprises at least one of silicon, a silicon oxide, a silicon nitride, metal, and a polymer.

19. The audio sensing device of claim 1, wherein sound frequency bands sensed by the plurality of resonators correspond to dimensions of the plurality of resonators.

20. The audio sensing device of claim 1, wherein the membrane is configured to receive an input audio signal of an audible frequency range or an ultrasonic frequency range.

21. An audio sensing device comprising:

a membrane configured to vibrate in response to sound; and a plurality of resonators provided on the membrane and respectively configured to sense different frequency bands of the sound, wherein each of the plurality of resonators comprises:

a first electrode provided on the membrane; and a second electrode provided on the membrane and spaced apart from the first electrode, and wherein the first electrode is disposed between the membrane and the second electrode.

22. The audio sensing device of claim 21, wherein the plurality of resonators are disposed in a vacuum state.

23. The audio sensing device of claim 21, wherein the first electrode is a common electrode.

24. The audio sensing device of claim 21, further comprising an insulating layer is interposed between the membrane and the first electrode.

25. The audio sensing device of claim 21, wherein each of the plurality of resonators further comprises an insulating layer interposed between the first electrode and the second electrode and provided on one of the first electrode and the second electrode.

26. The audio sensing device of claim 21, wherein one end or opposite ends of the second electrode are fixed on the membrane.

27. The audio sensing device of claim 21, wherein the first and second electrodes comprise a conductive material.

28. The audio sensing device of claim 21, wherein each of the plurality of resonators further comprises:

a piezoelectric layer interposed between the first electrode and the second electrode.

29. The audio sensing device of claim 28, wherein one end or opposite ends of the first electrode are fixed on the membrane.

30. The audio sensing device of claim 28, further comprising an insulating layer is interposed between the membrane and the first electrode.

31. The audio sensing device of claim 28, wherein the piezoelectric layer comprises at least one of ZnO, SnO, PZT, $ZnSnO_3$, polyvinylidene fluoride (PVDF), poly(vinylidene fluoride-trifluoroethylene) (P(VDF-TrFE)), AlN, and PMN-PT.

32. The audio sensing device of claim 28, wherein the first and second electrodes comprise a conductive material.

33. The audio sensing device of claim 21 wherein at least two of the plurality of resonators are configured to sense frequencies of a same band.

34. The audio sensing device of claim 21, further comprising a substrate, wherein the membrane is provided on the substrate, and wherein the substrate comprises silicon.

35. The audio sensing device of claim 21, wherein the membrane comprises at least one of silicon, a silicon oxide, a silicon nitride, metal, and a polymer.

36. The audio sensing device of claim 21, wherein sound frequency bands sensed by the plurality of resonators correspond to dimensions of the plurality of resonators.

* * * * *